US011392084B2

(12) United States Patent
Sugiura et al.

(10) Patent No.: US 11,392,084 B2
(45) Date of Patent: Jul. 19, 2022

(54) IMAGE FORMING APPARATUS TO WHICH CARTRIDGE IS ATTACHABLE AND INCLUDING CONTROLLER CAPABLE OF DETERMINING WHETHER CARTRIDGE IS ATTACHED TO IMAGE FORMING APPARATUS

(71) Applicant: BROTHER KOGYO KABUSHIKI KAISHA, Nagoya (JP)

(72) Inventors: Shinta Sugiura, Nagoya (JP); Keita Inoue, Konan (JP); Tatsuro Yokoi, Nagoya (JP); Seiya Sato, Yokkaichi (JP); Osamu Takahashi, Nagoya (JP); Toshinori Araki, Hekinan (JP); Masaaki Wakizaka, Nagoya (JP); Koji Akagi, Inazawa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/034,786

(22) Filed: Sep. 28, 2020

(65) Prior Publication Data

US 2021/0096498 A1 Apr. 1, 2021

(30) Foreign Application Priority Data

Sep. 30, 2019 (JP) ..... JP2019-178765

(51) Int. Cl.
*G03G 21/18* (2006.01)
*G03G 15/00* (2006.01)

(52) U.S. Cl.
CPC ..... *G03G 21/1892* (2013.01); *G03G 15/55* (2013.01); *G03G 15/80* (2013.01); *G03G 21/1882* (2013.01); *G03G 21/1885* (2013.01)

(58) Field of Classification Search
CPC ..... G03G 21/1892; G03G 21/1882; G03G 15/80; G03G 15/24; G03G 21/55
See application file for complete search history.

(56) References Cited

U.S. PATENT DOCUMENTS 7,826,780 B2 * 11/2010 Deguchi ..... G03G 21/1889 399/262
8,073,346 B2 * 12/2011 Sakai ..... G03G 15/55 399/13

(Continued)

FOREIGN PATENT DOCUMENTS

JP 2019-117346 A 7/2019

*Primary Examiner* — Arlene Heredia
(74) *Attorney, Agent, or Firm* — Merchant. & Gould P.C.

(57) ABSTRACT

An image forming apparatus includes a controller, a main body frame, a cartridge and a display. The cartridge includes a memory, a cartridge data terminal and a cartridge detection terminal. The controller includes a main body data terminal and a main body detection terminal. The main body data terminal is electrically connected to the cartridge data terminal. The main body detection terminal is electrically connected to the cartridge detection terminal in the case where the cartridge is attached to the main body frame. The controller is configured to perform determining whether the main body detection terminal and the cartridge detection terminal are electrically connected with each other. The controller is configured to perform displaying a determination result of the determining whether the main body detection terminal and the cartridge detection terminal are electrically connected with each other on the display.

14 Claims, 12 Drawing Sheets

(56) References Cited

U.S. PATENT DOCUMENTS

| | | | | |
|---|---|---|---|---|
| 2010/0202788 | A1* | 8/2010 | Suda | G03G 15/0863 399/27 |
| 2014/0301744 | A1* | 10/2014 | Tenjiku | G03G 21/1842 399/13 |
| 2019/0196394 | A1 | 6/2019 | Kabuki et al. | |

* cited by examiner

IMAGE FORMING APPARATUS TO WHICH CARTRIDGE IS ATTACHABLE AND INCLUDING CONTROLLER CAPABLE OF DETERMINING WHETHER CARTRIDGE IS ATTACHED TO IMAGE FORMING APPARATUS

CROSS REFERENCE TO RELATED APPLICATION

This application claims priority from Japanese Patent Application No. 2019-178765 filed Sep. 30, 2019. The entire content of the priority application is incorporated herein by reference.

TECHNICAL FIELD

The present disclosure relates to an image forming apparatus.

BACKGROUND

An electro-photographic type image forming apparatus such as a laser printer and an LED printer is well known in the art. The image forming apparatus includes a drum cartridge and a toner cartridge. The drum cartridge includes a photosensitive drum. The toner cartridge includes a developing roller. The toner cartridge is attachable to and detachable from the drum cartridge. In a case where the toner cartridge is attached to the drum cartridge, the developing roller of the toner cartridge and the photosensitive drum of the drum cartridge are in contact with each other.

Further, there has been conventionally known a toner cartridge including a toner memory serving as a storage medium. The toner memory stores various information with respect to the toner cartridge. In recent years, the image forming apparatus handles not only information related to the toner cartridge, but also information related to the drum cartridge. Therefore, the drum cartridge is required to be provided with a drum memory serving as a storage medium for storing information related to the drum cartridge.

SUMMARY

There is such a conventional image forming apparatus that has both of a drum memory and a toner memory. In the conventional image forming apparatus, after a cover of the image forming apparatus is closed, a controller of the image forming apparatus determines whether communication with the drum memory is available. When the drum cartridge is not attached to the image forming apparatus, the controller determines that communication with the drum memory is not available. However, in the conventional image forming apparatus, when communication with the drum memory is not available, it cannot be determined whether the communication with the drum memory is not available because the drum cartridge is not attached to the image forming apparatus or because communication between the controller and the drum memory is disabled.

In view of the foregoing, it is an object of the present disclosure to provide a technology allowing determination of whether a cartridge is attached to an image forming apparatus and is established, without communication with the memory.

In order to attain the above and other objects, according to one aspect, the disclosure provides an image forming apparatus including a controller, a main body frame, a cartridge and a display. The cartridge is attachable to the main body frame. The cartridge includes a memory, a cartridge data terminal and a cartridge detection terminal. The memory stores information related to the cartridge. The cartridge data terminal is configured to communicate the information stored in the memory. The controller includes a main body data terminal and a main body detection terminal. The main body data terminal is electrically connected to the cartridge data terminal in a case where the cartridge is attached to the main body frame. The main body detection terminal is electrically connected to the cartridge detection terminal in the case where the cartridge is attached to the main body frame. The controller is configured to perform determining whether the main body detection terminal and the cartridge detection terminal are electrically connected with each other. The controller is configured to perform displaying a determination result of the determining whether the main body detection terminal and the cartridge detection terminal are electrically connected with each other on the display.

BRIEF DESCRIPTION OF THE DRAWINGS

The particular features and advantages of the disclosure will become apparent from the following description taken in connection with the accompanying drawings, in which.

DETAILED DESCRIPTION

Hereinafter, an image forming apparatus 100 according to one embodiment of the present disclosure will be described with reference to FIGS. 1 through 8.

In the following description, an extending direction of a photosensitive drum will be referred to as a "first direction". Further, a direction in which a plurality of photosensitive drums are arranged will be referred to as a "second direction". The first direction and the second direction intersect with each other. Preferably, the first direction and the second direction are perpendicular to each other.

<1. Configuration of Image Forming Apparatus>

Figure 1:
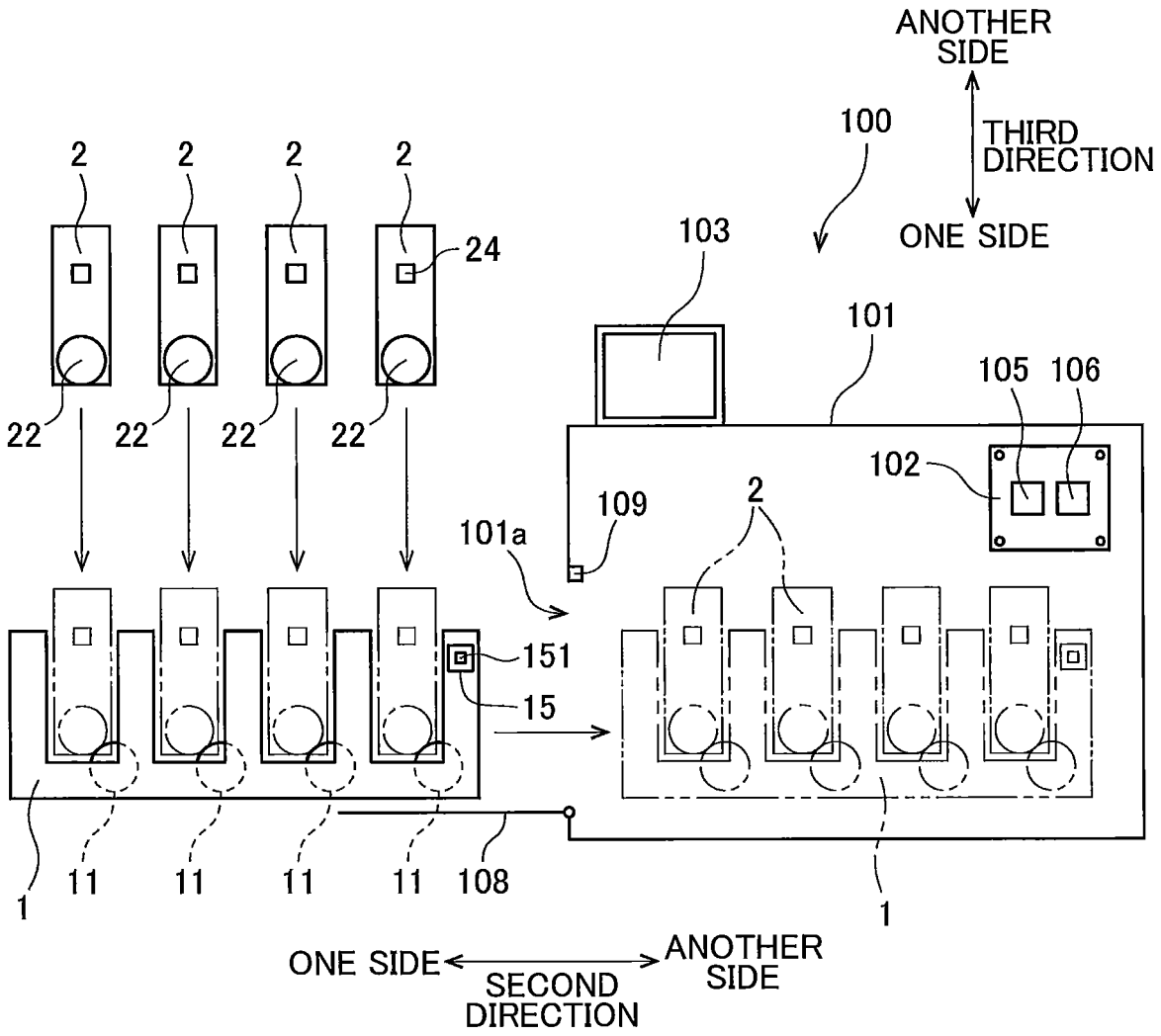
FIG. 1 is a conceptual diagram illustrating an image forming apparatus according to one embodiment of the present disclosure.

FIG. 1 is a conceptual diagram of the image forming apparatus 100. The image forming apparatus 100 is an electro-photographic printer. The image forming apparatus 100 may be a laser printer or a light emitting diode (LED) printer, for example. As illustrated in FIG. 1, the image forming apparatus 100 includes a main body frame 101, a controller 102, a display 103, a cover 108, a drum cartridge 1, and a plurality of toner cartridges 2.

The main body frame 1 has an insertion opening 101*a*. The cover 8 is pivotally movable with respect to the main body frame 101 between a closed position and an open position. The closed position is a position where the cover 108 closes the insertion opening 101*a*, and the open position is a position where the cover 108 opens the insertion opening 101*a*. The image forming apparatus 100 includes a sensor 109. The sensor 109 is configured to detect whether the cover 108 is pivoted from the open position to the closed position. When the sensor 109 detects that the cover 108 has pivoted from the open position to the closed position, a detection signal indicating that the cover has pivoted to the closed position is sent to the controller 102.

Each of the plurality of toner cartridges 2 can be individually attached to the drum cartridge 1. The drum cartridge 1, to which the plurality of the toner cartridges 2, are attached can be attached to the main body frame 101 through the insertion opening 101*a*. The plurality of toner cartridges 2 store toner (developing agents) of respective colors such as cyan, magenta, yellow, and black, respectively. The image forming apparatus 100 is configured to form an image on a recording surface of a printing sheet with toner supplied from the plurality of toner cartridges 2. Although the number of the toner cartridges 2 attachable to the drum cartridge 1 is four according to this embodiment, the number of toner cartridges 2 attachable to the drum cartridge 1 may be one, two, three, five or more.

The drum cartridge 1 includes a drum circuit board 15 and a drum memory 151. The drum memory 151 is a storage medium, to which information can be written and from which information can be read. Each of the plurality of toner cartridges 2 includes a toner memory 24. The toner memory 24 is a storage medium, to which information can be written and from which information can be read.

The controller 102 is positioned inside the main body frame 101 of the image forming apparatus 100. The controller 102 includes, for example, a circuit board, a processor 105 such as a CPU, and a main body memory 106 serving as a storage medium. The controller 102 executes various processes by the processor 105 operating according to a program stored in the main body memory 106. Specifically, the controller 102 executes a reading process to read information from the main body memory 106 and an operating process for operating the image forming apparatus 100 based on the information read by the reading process.

In a case where the plurality of toner cartridges 2 are attached to the drum cartridge 1, the toner memory 24 of each toner cartridge 2 is electrically connected to the drum circuit board 15. Further, in a case where the drum cartridge 1 attached with the toner cartridges 2 is mounted in the main body frame 101, the controller 102 in the main body frame 101 and the drum circuit board 15 are electrically connected with each other. Accordingly, the toner memory 24 of each of plurality of toner cartridges 2 and the controller 102 are electrically connected with each other through the drum circuit board 15.

The display 103 is, for example, a liquid crystal display or an organic EL display. The display 103 is configured to display various information with respect to the operation of the image forming apparatus 100 on a screen according to an instruction from the controller 102.

<2. Configuration of Drum Cartridge>

Figure 2:
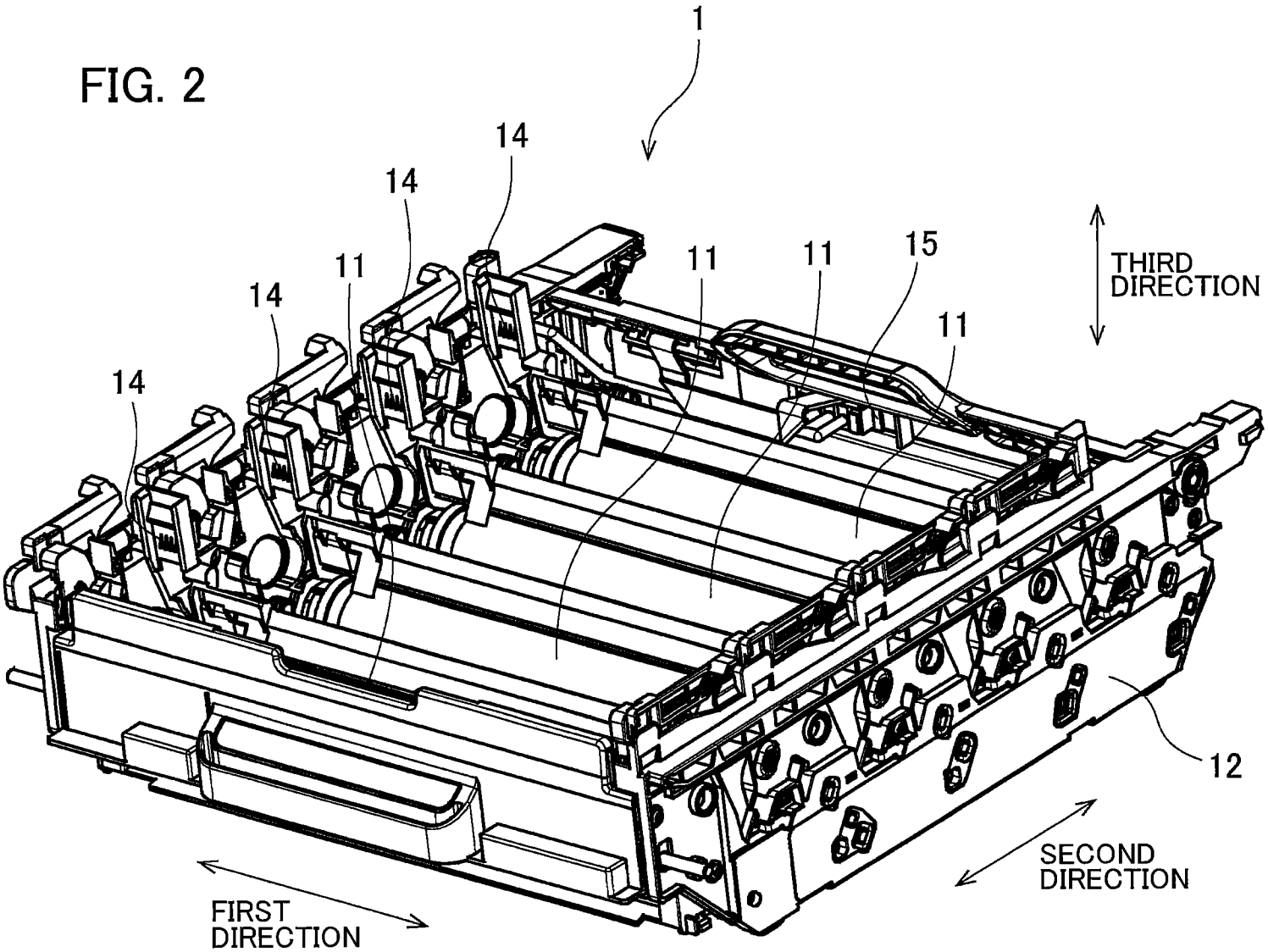
FIG. 2 is a perspective view illustrating a drum cartridge according to the embodiment.
Figure 3:
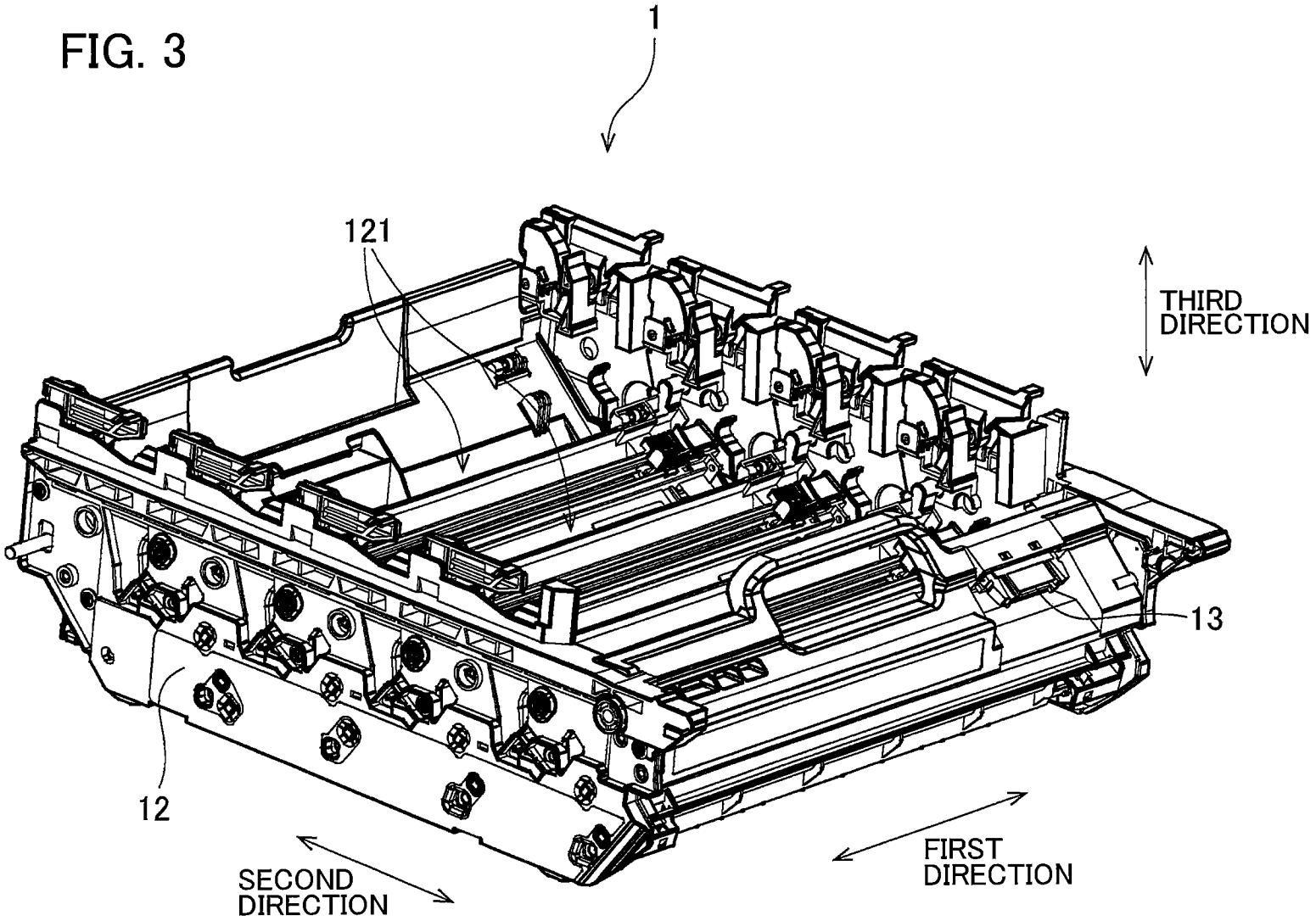
FIG. 3 is another perspective view illustrating the drum cartridge according to the embodiment.

Next, the configuration of drum cartridge 1 will be described. FIGS. 2 and 3 are perspective views of the drum cartridge 1.

As illustrated in FIGS. 2 and 3, the drum cartridge 1 includes a plurality of photosensitive drums 11, a drum frame 12, a first connector 13, a plurality of second connectors 14 and the drum circuit board 15. In the present embodiment, the number of the photosensitive drums 11 is four, and the number of the plurality of second connectors 14 is four.

Each of the photosensitive drums 11 is configured to transfer toner supplied from the toner cartridge 2 to printing paper. The plurality of photosensitive drums 11 are arranged in the second direction at predetermined intervals therebetween. Each of the photosensitive drums 11 has a cylindrical outer peripheral surface extending in the first direction. The outer peripheral surface of the photosensitive drum 11 is covered with a photosensitive material. Further, each of the photosensitive drums 11 is rotatable about a rotation axis extending in the first direction.

The drum frame 12 is a frame body for holding the plurality of photosensitive drums 11. The drum frame 12 includes a plurality of toner cartridge holders 121. The plurality of toner cartridge holders 121 are arranged in the second direction at predetermined intervals therebetween. Each of the toner cartridge 2 is attachable to the corresponding toner cartridge holder 121. Thus, the plurality of the toner cartridges are attachable to the drum frame 12. When one of the toner cartridges 2 is attached to the toner cartridge holder 121, the outer peripheral surface of the photosensitive drum 11 and an outer peripheral surface of the developing roller 22 provided in the toner cartridge 2 (described later) are in contact with each other.

Figure 4:
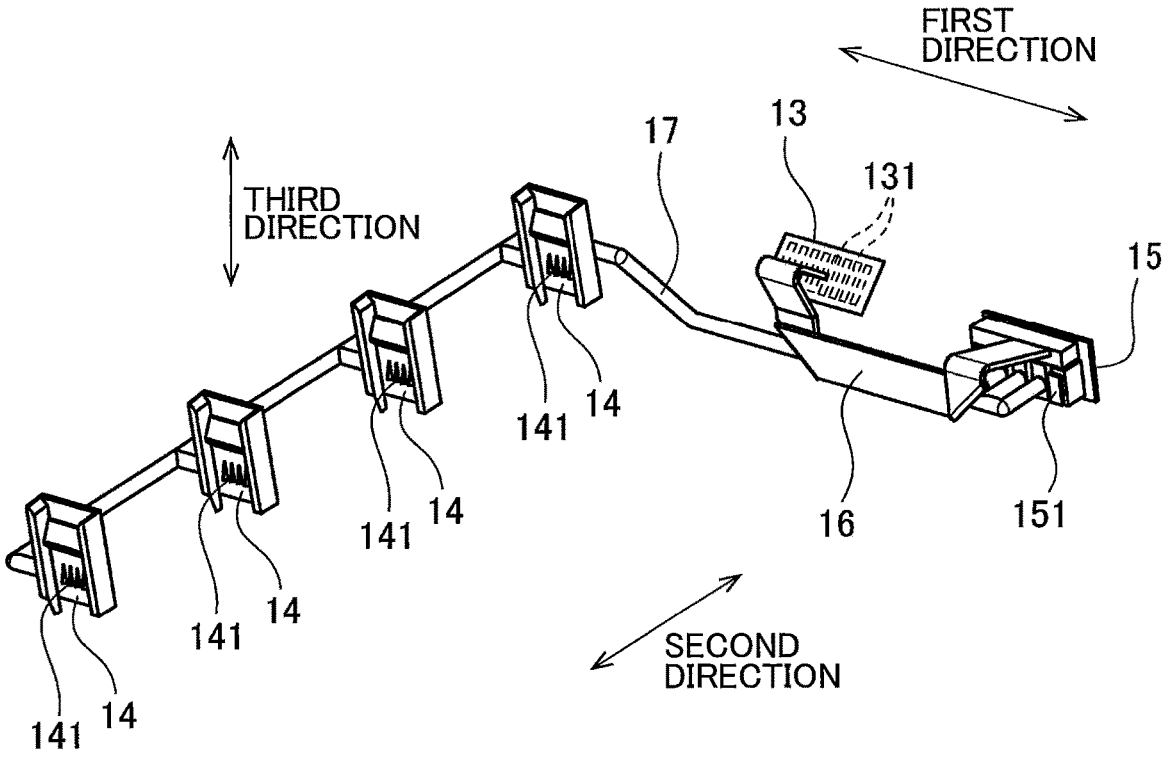
FIG. 4 is a perspective view illustrating a first connector, a plurality of second connectors, a drum circuit board, and harnesses according to the embodiment.

FIG. 4 is a perspective view illustrating the first connector 13, the plurality of the second connectors 14, the drum circuit board 15 and harnesses 16 and 17 for connecting the first connector 13, the plurality of second connectors 14 and the drum circuit board 15.

The first connector 13 is for being electrically connected to one or more terminals provided at the main body frame 101 when the drum cartridge 1 is attached to the main body frame 101 of the image forming apparatus 100. The first connector 13 is, for example, fixed to a surface of the drum frame 12. Incidentally, the first connector 13 may be immovable or slightly movable with respect to the drum frame 12. The first connector 13 has a plurality of first terminals 131. Each of the first terminals 131 is a conductor exposed on a surface of the drum frame 12. Each of the first terminals 131 is electrically connected to a corresponding one of a plurality of main body side drum voltage terminals 31 (described later) of the drum circuit board 15.

The plurality of second connectors 14 are for being electrically connected to terminals 242 of the toner memories 24 (described later) when the toner cartridges 2 are attached to the toner cartridge holders 121. The plurality of second connectors 14 are provided for the toner cartridge holders 121, respectively. Each of the second connectors 14 is located at an end of the corresponding toner cartridge holder 121 in the first direction. Further, each of the plurality of second connectors 14 is, for example, fixed to the surface of the drum frame 12. Incidentally, the plurality of second connector 14 may be immovable or slightly movable with respect to the drum frame 12. Each of the plurality of second connectors 14 has a plurality of second terminals 141. Each of the second terminals 141 is a conductor exposed on the surface of the drum frame 12. Each of the second terminals 141 is electrically connected to a corresponding one of a plurality of toner side drum voltage terminals 32 (described later) of the drum circuit board 15.

The drum circuit board 15 is a circuit board electrically connected to the first connector 13 and the plurality of second connectors 14. The drum circuit board 15 is, for example, fixed to the surface of the drum frame 12. As illustrated in FIG. 4, the drum circuit board 15 is electrically connected with the first connector 13 through the first harness 16. Further, the drum circuit board 15 is electrically connected with the plurality of second connectors 14 through the second harness 17. Each of the first harness 16 and the second harness 17 is a wire harnesses including a plurality of conducting wires, for example.

Further, as illustrated in FIG. 4, the drum cartridge 1 includes the drum memory 151 serving as a storage medium. The drum memory 151 is provided on the drum circuit board 15. Incidentally, the drum memory 151 may not be provided on the drum circuit board 15. Specifically, the drum memory 151 may be provided at a surface of the drum frame 12.

The drum memory 151 stores therein various information related to the drum cartridge 1. For example, the drum memory 151 stores therein at least one of information identifying the drum cartridge 1 and information indicating the characteristics of the drum cartridge 1. The information identifying the drum cartridge 1 includes, for example, at least one of: a manufacturing serial number of the drum cartridge 1; and an identification code indicating that the drum cartridge 1 is a genuine product. The information indicating the characteristics of the drum cartridge 1 includes, for example, at least one of the following pieces of information: information indicating models of image forming apparatuses to which the drum cartridge 1 is attachable; a specification of the drum cartridge 1; a service life of the photosensitive drum 11; charging characteristics of the photosensitive drum 11; information indicating whether the drum cartridge 1 is new; the total number of rotations by which the photosensitive drum 11 has been rotated; the total length of the charged times during which the photosensitive drum 11 has been charged; the total number of sheets that have been printed by the photosensitive drum 11; and an error history of the drum cartridge 1.

The drum memory 151 has a first storage area and a second storage area. The first storage area is an area for storing non-rewritable information. The second storage area is an area for storing rewritable information. The first storage area stores therein, for example, at least one of: the manufacturing serial number; the identification code; the information indicating models of image forming apparatuses to which the drum cartridge 1 is attachable; the specification; and the service life of the photosensitive drum 11, all of which is described above. The second storage area stores therein, for example, information indicating usage status of the drum cartridge 1. The information indicating the usage status of the drum cartridge 1 includes, for example, at least one of: the information indicating whether the drum cartridge 1 is new; the total number of rotations by which the photosensitive drum 11 has been rotated; the total length of charged times during which the photosensitive drum 11 has been charged; the total number of sheets that have been printed by the photosensitive drum 11; and the error history of the drum cartridge 1, all of which is described above.

<3. Configuration of Toner Cartridge>

Next, the configuration of the toner cartridge 2 will be described. In the following, the configuration of the toner cartridge 2 in the state where the toner cartridge 2 is attached to the drum cartridge 1 will be described using the above-described first direction and second direction.

Figure 5:
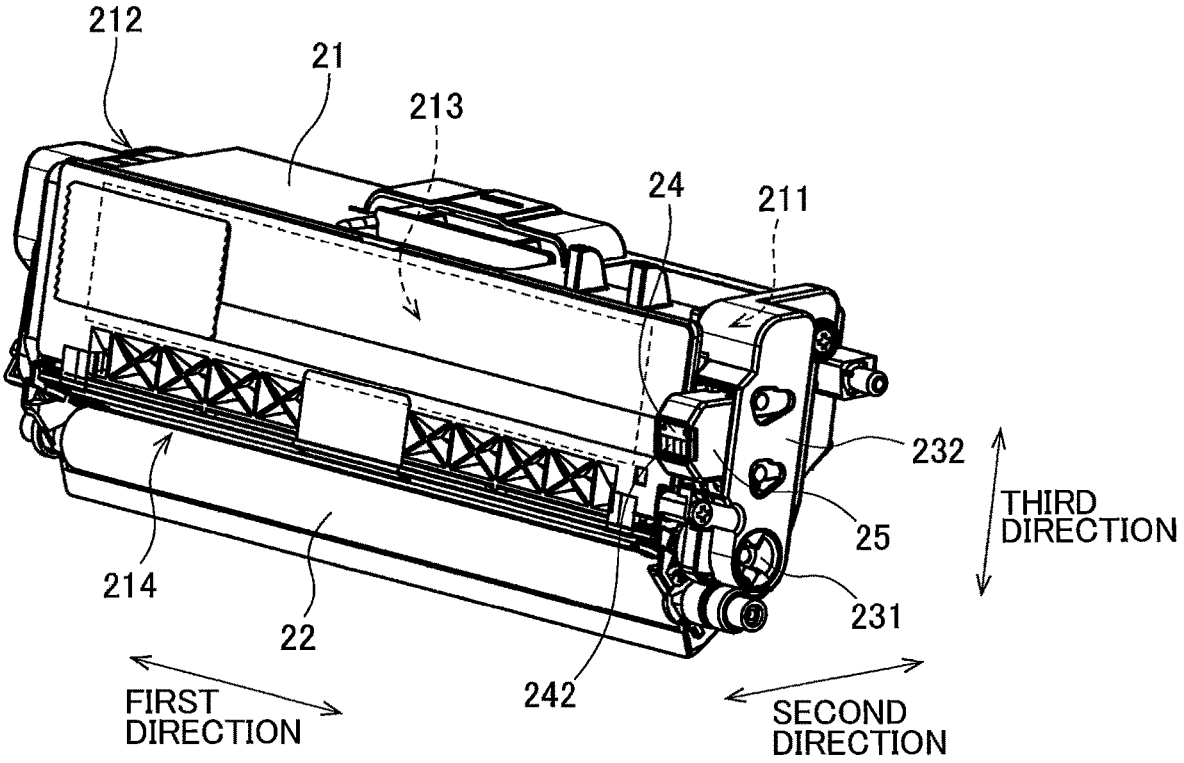
FIG. 5 is a perspective view illustrating a toner cartridge according to the embodiment.

FIG. 5 is a perspective view of the toner cartridge 2. As illustrated in FIG. 5, the toner cartridge 2 includes a casing 21, a developing roller 22, a plurality of gears, a coupling 231, a gear cover 232, the toner memory 24, and a holder 25.

The casing 21 is a housing configured to accommodate toner therein. The casing 21 extends in the first direction between a first outer surface 211 and a second outer surface 212. A chamber 213 is formed inside the casing 21. The chamber 213 stores the toner therein. Further, the casing 2 has an opening 214. The opening 214 is positioned at one end of the casing 21 in a third direction which intersects both of the first direction and the second direction. The chamber 213 communicates with an outside of the casing 21 through the opening 214.

The developing roller 22 is a roller rotatable about a rotation axis extending in the first direction. The developing roller 22 is positioned at the opening 214 of the casing 21. That is, the developing roller 22 is positioned at one end of the casing 21 in the third direction. When the toner cartridge 2 is attached to the drum cartridge 1, the outer peripheral surface of the developing roller 22 is in contact with the outer peripheral surface of the photosensitive drum 11.

The toner is supplied from the chamber 213 to the photosensitive drum 11 through the developing roller 22. The toner carried on the outer surface of the developing roller 22 moves from the developing roller 22 to the photosensitive drum 11 according to the electrostatic latent image formed on the outer surface of the photosensitive drum 11. As a result, the electrostatic latent image is developed into a visible image on the outer surface of the photosensitive drum 11.

The plurality of gears, the coupling 231 and the gear cover 232 are positioned at the first outer surface 211 of the casing 21. The gear cover 232 is fixed to the first outer surface 211 of the casing 21 with, for example, screws. At least one of the plurality of gears is positioned between the first outer surface 211 of the casing 21 and the gear cover 232. The coupling 231 is exposed outside of the gear cover 232. When the drum cartridge 1 attached with the toner cartridges 2 is attached to the main body frame 101 of the image forming apparatus 100, drive shafts of the image forming apparatus 100 are connected to the couplings 231 of the toner cartridges 2, and rotation of each drive shaft is transmitted to the developing roller 22 of the corresponding toner cartridge 2 through the coupling 231 and the plurality of gears of the corresponding toner cartridge 2.

The toner memory 24 and the holder 25 are positioned between the first outer surface 211 of the casing 21 and the gear cover 232 in the first direction. The holder 25 holds the toner memory 24. The holder 25 is movable relative to both of the casing 21 and the gear cover 232 in the second direction. Incidentally, the holder 25 may be fixed relative to both of the casing 21 and the gear cover 232. Further, the toner memory 24 may be positioned at another position different from the position between the first outer surface 211 and the gear cover 232. For example, the toner memory 24 may be positioned on a surface of the casing 21.

The toner memory 24 has a plurality of terminals 242. Each of the terminals 242 is a conductor exposed on a surface of the toner memory 24. When the toner cartridge 2 is attached to the toner cartridge holder 121 of the drum cartridge 1, the terminals 242 of the toner memory 24 are in contact with the second terminals 141 of the plurality of second connector 14. In the present embodiment, the number of the terminals 242 of the toner memory 24 is four, and the number of the second terminals 141 of each second connector 14 is four.

The toner memory 24 stores therein various information related to the toner cartridge 2. For example, the toner memory 24 stores therein at least one of information identifying the toner cartridge 2 and information indicating the characteristics of the toner cartridge 2. The information identifying the toner cartridge 2 includes, for example, at least one of: a manufacturing serial number of the toner cartridge 2; and an identification code indicating that the toner cartridge is a genuine product. The information indicating the characteristics of the toner cartridge 2 includes, for example, at least one of the following pieces of information: information indicating models of image forming apparatuses to which the toner cartridge 2 can be used; a specification of the toner cartridge 2; a service life of the developing roller 22; information indicating whether the toner cartridge 2 is new; the total number of rotations by which the developing roller 22 has been rotated; the total number of sheets that have been printed by the developing roller 22; and an error history of the toner cartridge 2.

<4. Controller>

Figure 6:
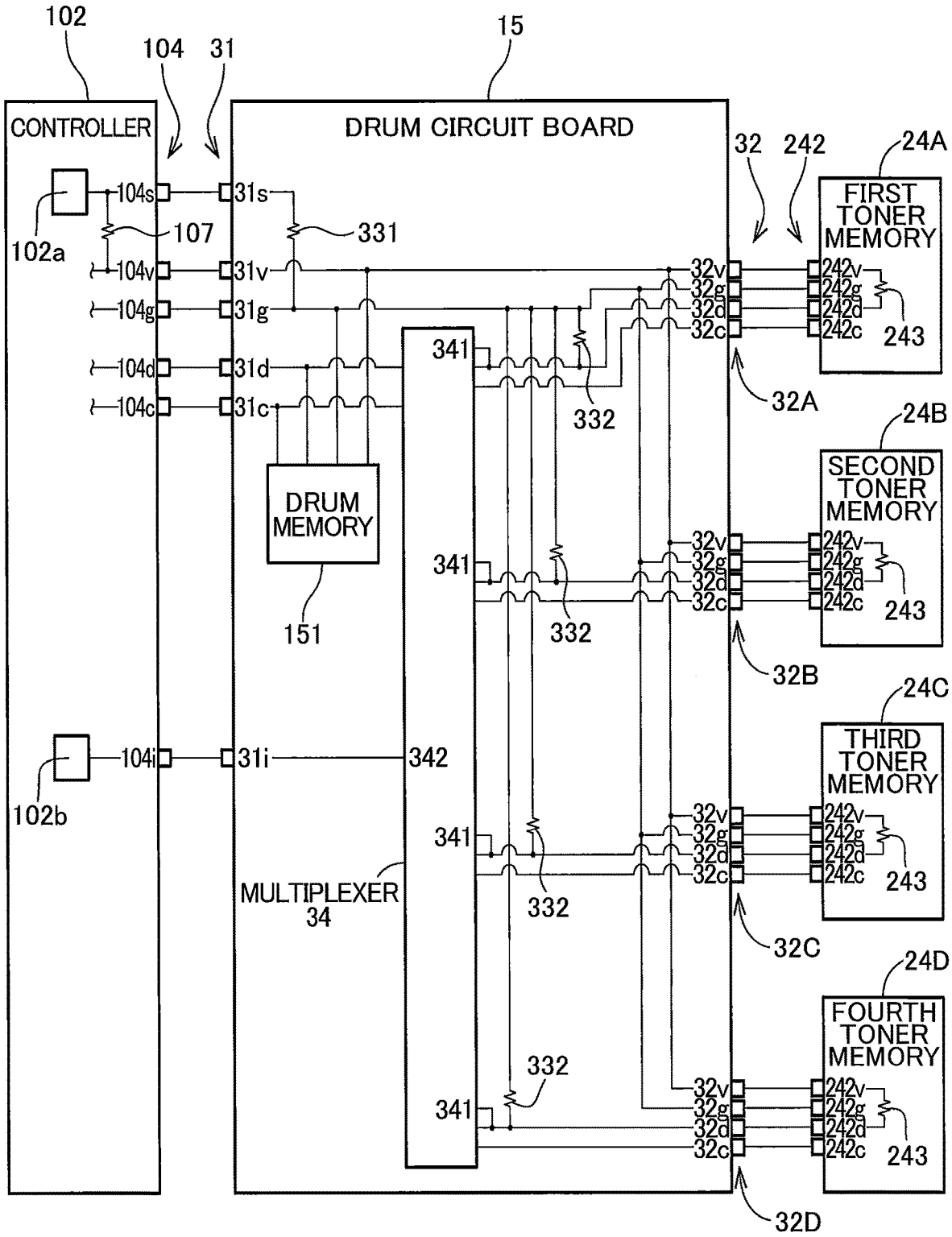
FIG. 6 is a block diagram showing an electrical connection among a controller, the drum circuit board, and four toner memories according to the embodiment.

Next, description will be made with respect to the terminals of the controller 102. FIG. 6 is a block diagram illustrating electrical connection between the controller 102, the drum circuit board 15, and the toner memories 24. As illustrated in FIG. 6, the controller 102 has a plurality of main body terminals 104. The plurality of main body terminals 104 include a main body voltage terminal 104*v*, a main body ground terminal 104*g*, a main body data terminal 104*d*, a main body clock terminal 104*c*, a main body detection terminal 104*s*, and a main body interrupt terminal 104*i*.

The main body voltage terminal 104*v* is a terminal for supplying voltage to a main body side drum voltage terminal 31*v* (described later) of the drum circuit board 15. The controller 102 supplies a constant first voltage to the main body voltage terminal 104*v* based on power supplied from an outside of the controller 102.

The main body ground terminal 104*g* is a terminal for grounding a main body side drum ground terminal 31*g* (described later) of the drum circuit board 15. The voltage value of the main body ground terminal 104*g* is a constant ground voltage lower than the first voltage.

The main body data terminal 104*d* is a terminal for transmitting and receiving data between the controller 102 and the drum circuit board 15. The main body data terminal 104*d* is electrically connected to the processor 105 of the controller 102.

The main body clock terminal 104*c* is a terminal for supplying a clock signal having a constant period from the controller 102 to the drum circuit board 15.

The main body detection terminal 104*s* is a terminal for detecting whether the drum cartridge 1 is attached to the main body frame 101. As illustrated in FIG. 6, the controller 102 has a voltage measurement circuit 102*a* for measuring voltage at the main body detection terminal 104*s*. Further, the controller 102 has a main body resistor 107. The main body resistor 107 is an electric resistor. The main body resistor 107 has one end connected to the main body detection terminal 104*s* and another end connected to the main body voltage terminal 104*v*.

The main body interrupt terminal 104*i* is a terminal for receiving an interrupt signal from a multiplexer 34 (described later). As illustrated in FIG. 6, the controller 102 has a signal detection circuit 102*b* for detecting the interrupt signal through the main body interrupt terminal 104*i* when the main body interrupt terminal 104*i* receives the interrupt signal from the multiplexer 34.

<5. Drum Circuit Board>

The following describes in detail the configuration of the drum circuit board 15. In the example of FIG. 6, the drum circuit board 15 has a plurality of main body side drum terminals 31, a plurality of toner side drum terminals 32, the multiplexer 34, and a drum memory 151. It should be noted that, as described above, the drum memory 151 may not be positioned on the drum circuit board 15. Similarly, the multiplexer 34 may not be positioned on the drum circuit board 15. For example, the multiplexer 34 and the drum memory 151 may be positioned on the surface of the drum frame 12.

<5-1. Main Body Side Drum Terminal>

The plurality of main body side drum terminals 31 are electrically connected to the main body terminals 104 of the controller 102 through the above-described first connector 13 in the state where the drum cartridge 1 is attached to the main body frame 101 of the image forming apparatus 100. This allows the drum circuit board 15 and the controller 102 to be electrically connected with each other. The plurality of main body side drum terminals 31 include a main body side drum voltage terminal 31*v*, a main body side drum ground terminal 31*g*, a main body side drum data terminal 31*d*, a main body side drum clock terminal 31*c*, a drum detection terminal 31*s*, and a drum interrupt terminal 31*i*.

The main body side drum voltage terminal (cartridge voltage terminal) 31*v* is electrically connected to the main body voltage terminal 104*v* in the state where the drum cartridge 1 is attached to the main body frame 101 of the image forming apparatus 100. This allows the first voltage to be supplied from the controller 102 to the main body side drum voltage terminal 31*v* through the main body voltage terminal 104*v*. As illustrated in FIG. 6, the main body side drum voltage terminal 31*v* is electrically connected to the drum memory 151.

The main body side drum ground terminal (cartridge ground terminal) 31*g* is electrically connected to the main body ground terminal 104*g* in the state where the drum cartridge 1 is attached to the main body frame 101 of the image forming apparatus 100. This allows the main body side drum ground terminal 31*g* to be grounded. That is, the voltage value of the main body side drum ground terminal 31*g* is the ground voltage lower than the first voltage. As illustrated in FIG. 6, the main body side drum ground terminal 31*g* is electrically connected to the drum memory 151.

The main body side drum data terminal (cartridge data terminal) 31*d* is electrically connected to the main body data terminal 104*d* in the state where the drum cartridge 1 is attached to the main body frame 101 of the image forming apparatus 100. This allows data to be transmitted and received between the controller 102 and the drum circuit board 15. As illustrated in FIG. 6, the main body side drum data terminal 31*d* is electrically connected to the multiplexer 34 and the drum memory 151.

The main body side drum clock terminal 31*c* is electrically connected to the main body clock terminal 104*c* in the state where the drum cartridge 1 is attached to the main body frame 101 of the image forming apparatus 100. This allows a clock signal to be supplied from the controller 102 to the drum circuit board 15 at a constant time interval. As illustrated in FIG. 6, the main body side drum clock terminal 31*c* is electrically connected to the multiplexer 34 and the drum memory 151.

The drum detection terminal (cartridge detection terminal) 31*s* is electrically connected to the main body detection terminal 104*s* in the state where the drum cartridge 1 is attached to the main body frame 101 of the image forming apparatus 100. As illustrated in FIG. 6, the drum circuit board 15 has a first drum resistor (cartridge resistor) 331. The first drum resistor 331 is an electric resistor. The first drum resistor 331 has one end of the first drum resistor 331 connected to the drum detection terminal 31*s* and another end connected to the main body side drum ground terminal 31*g*.

The drum interrupt terminal 31*i* is electrically connected to the main body interrupt terminal 104*i* in the state where the drum cartridge 1 is attached to the main body frame 101 of the image forming apparatus 100. As illustrated in FIG. 6, the drum interrupt terminal 31*i* is electrically connected to an interrupt output port 342 (described later) of the multiplexer 34.

<5-2. Toner Side Drum Terminal>

The plurality of toner side drum terminals 32 are electrically connected to the toner memories 24 of the toner cartridges 2 through the above-described plurality of second connectors 14 in the state where the toner cartridges 2 are attached to the drum frame 12 of the drum cartridge 1. This allows the drum circuit board 15 and the toner memories 24 to be electrically connected with each other.

Hereinafter, four toner cartridges 2 to be attached to the drum cartridge 1 are referred to as a first toner cartridge 2A, a second toner cartridge 2B, a third toner cartridge 2C, and a fourth toner cartridge 2D. The toner memory 24 for the first toner cartridge 2A is referred to as a first toner memory 24A, the toner memory 24 for the second toner cartridge 2B is referred to as a second toner memory 24B, the toner memory 24 for the third toner cartridge 2C is referred to as a third toner memory 24C, and the toner memory 24 for the fourth toner cartridge 2D is referred to as a fourth toner memory 24D.

As illustrated in FIG. 6, each toner memory 24 has a toner voltage terminal 242*v*, a toner ground terminal 242*g*, a toner data terminal 242*d*, and a toner clock terminal 242*c*. Further, each toner memory 24 has a toner resistor 243. The toner resistor 243 is an electric resistor. The toner resistor 243 has one end connected to the toner voltage terminal 242*v* and another end connected to the toner data terminal 242*d*.

The plurality of toner side drum terminals 32 include a first group 32A having four toner side drum terminals 32, a second group 32B having four toner side drum terminals 32, a third group 32C having four toner side drum terminals 32, and a fourth group 32D having four toner side drum terminals 32.

The toner side drum terminals 32 of the first group 32A are electrically connected to the first toner memory 24A in the state where the first toner cartridge 2A is attached to the drum frame 12 of the drum cartridge 1. The toner side drum terminals 32 of the second group 32B are electrically connected to the second toner memory 24B in the state where the second toner cartridge 2B is attached to the drum frame 12 of the drum cartridge 1. The toner side drum terminals 32 of the third group 32C are electrically connected to the third toner memory 24C in the state where the third toner cartridge 2C is attached to the drum frame 12 of the drum cartridge 1. The toner side drum terminals 32 of the fourth group 32D are electrically connected to the fourth toner memory 24D in the state where the fourth toner cartridge 2D is attached to the drum frame 12 of the drum cartridge 1.

The toner side drum terminals 32 of each group include a toner side drum voltage terminal 32*v*, a toner side drum ground terminal 32*g*, a toner side drum data terminal 32*d*, and a toner side drum clock terminal 32*c*.

The toner side drum voltage terminal 32*v* of each group is electrically connected to the main body side drum voltage terminal 31*v*. In the state where one toner cartridge 2 is attached to the drum frame 12 of the drum cartridge 1, the toner side drum voltage terminal 32*v* of the corresponding group is electrically connected to the toner voltage terminal 242*v* of the toner memory 24 in the toner cartridge 2. This allows the first voltage to be supplied from the controller 102 to the toner memory 24 through the drum circuit board 15.

The toner side drum ground terminal 32*g* of each group is electrically connected to the main body side drum ground terminal 31*g*. In the state where one toner cartridge 2 is attached to the drum frame 12 of the drum cartridge 1, the toner side drum ground terminal 32*g* of the corresponding group is electrically connected to the toner ground terminal 242*g* of the toner memory 24 in the toner cartridge 2. This allows the toner ground terminal 242*g* to be grounded.

The toner side drum data terminal 32*d* of each group is electrically connected to the multiplexer 34. In the state where one toner cartridge 2 is attached to the drum frame 12 of the drum cartridge 1, the toner side drum data terminal 32*d* of the corresponding group is electrically connected to the toner data terminal 242*d* of the toner memory 24 in the toner cartridge 2.

As illustrated in FIG. 6, the drum circuit board 15 has a second drum resistor 332. The second drum resistor 332 is an electric resistor. The second drum resistor has one end connected to the toner side drum data terminal 32*d* and the multiplexer 34, and another end connected to both of the main body side drum ground terminal 31*g* and the toner side drum ground terminal 32*g*.

The toner side drum clock terminal 32*c* of each group is electrically connected to the multiplexer 34. In the state where one toner cartridge 2 is attached to the drum frame 12 of the drum cartridge 1, the corresponding toner side drum clock terminal 32*c* is electrically connected to the toner clock terminal 242*c* of the toner memory 24.

The toner memory 24 may have such a configuration, in which the toner resistor 243 and an E2PROM, in which information can be written in serial communication and from which information can be read in serial communication, are mounted on a small substrate. In this case, the toner voltage terminal 242*v*, toner ground terminal 242*g*, toner data terminal 242*d*, and toner clock terminal 242*c* which are mounted on the small substrate are connected to the E2PROM, and the toner voltage terminal 242*v* and toner data terminal 242*d* which are mounted on the small substrate are connected to the toner resistor 243.

<5-3. Multiplexer>

The multiplexer 34 is a switch circuit for switching among the toner memories 24 to select one of the toner memories 24 as a communication destination. The multiplexer 34 receives a clock signal from the controller 102 through the main body side drum clock terminal 31*c*. Further, the multiplexer 34 supplies the input clock signal to the toner memories 24 through the toner side drum clock terminals 32*c*.

Further, the multiplexer 34 receives an address signal and a data signal from the controller 102 through the main body side drum data terminal 31*d*. The address signal is a signal for designating the toner memory 24 of a communication destination. The data signal is a signal indicating various information items to be transmitted to the toner memory 24 of a communication destination. The multiplexer 34 selects one of the four toner side drum data terminals 32*d* according to the received address signal. Then, the multiplexer 34 outputs the received data signal to the toner memory 24 through the selected toner side drum data terminal 32*d*.

That is, the multiplexer 34 can switch data transmission and/or reception among data transmission and/or reception for the first toner memory 24A, data transmission and/or reception for the second toner memory 24B, data transmission and/or reception for the third toner memory 24C, and data transmission and/or reception for the fourth toner memory 24D.

The multiplexer 34 has four interrupt input ports 341 and one interrupt output port 342 so as to allow the controller 102 to execute interrupt processing. The four interrupt input ports 341 are in one to one correspondence with the four groups 32A, 32B, 23C, and 32D. Each interrupt input port 341 is connected to the toner side drum data terminal 32*d* and the second drum resistor 332 in the corresponding group. The interrupt output port 342 is connected to the drum interrupt terminal 31*i*.

When the ground voltage is supplied to at least one of the four interrupt input ports 341, the multiplexer 34 outputs a first interrupt signal from the interrupt output port 342. On the other hand, when a second voltage higher than the ground voltage and lower than the first voltage is supplied to all the four interrupt input ports 341, the multiplexer 34 outputs a second interrupt signal from the interrupt output port 342. The first interrupt signal is a voltage signal. The second interrupt signal is also a voltage signal, but the value of the voltage of the second interrupt signal is different from that of the voltage of the first interrupt signal.

<5-4. Relay of Information by Drum Circuit Board>

In the state where the drum cartridge 1 attached with the toner cartridges 2 is attached to the main body frame 101 of the image forming apparatus 100, the controller 102 and the toner memories 24 are electrically connected with each other through the drum circuit board 15. With this configuration, the drum circuit board 15 can relay information between the controller 102 and the toner memories 24. For example, the controller 102 can read information stored in the toner memories 24 through the second harness 17, the drum circuit board 15, and the first harness 16. Further, the controller 102 can write data in the toner memory 24 through the first harness 16, the drum circuit board 15, and the second harness 17.

<6. Detection of Presence/Absence of Drum Cartridge>

Figure 7:
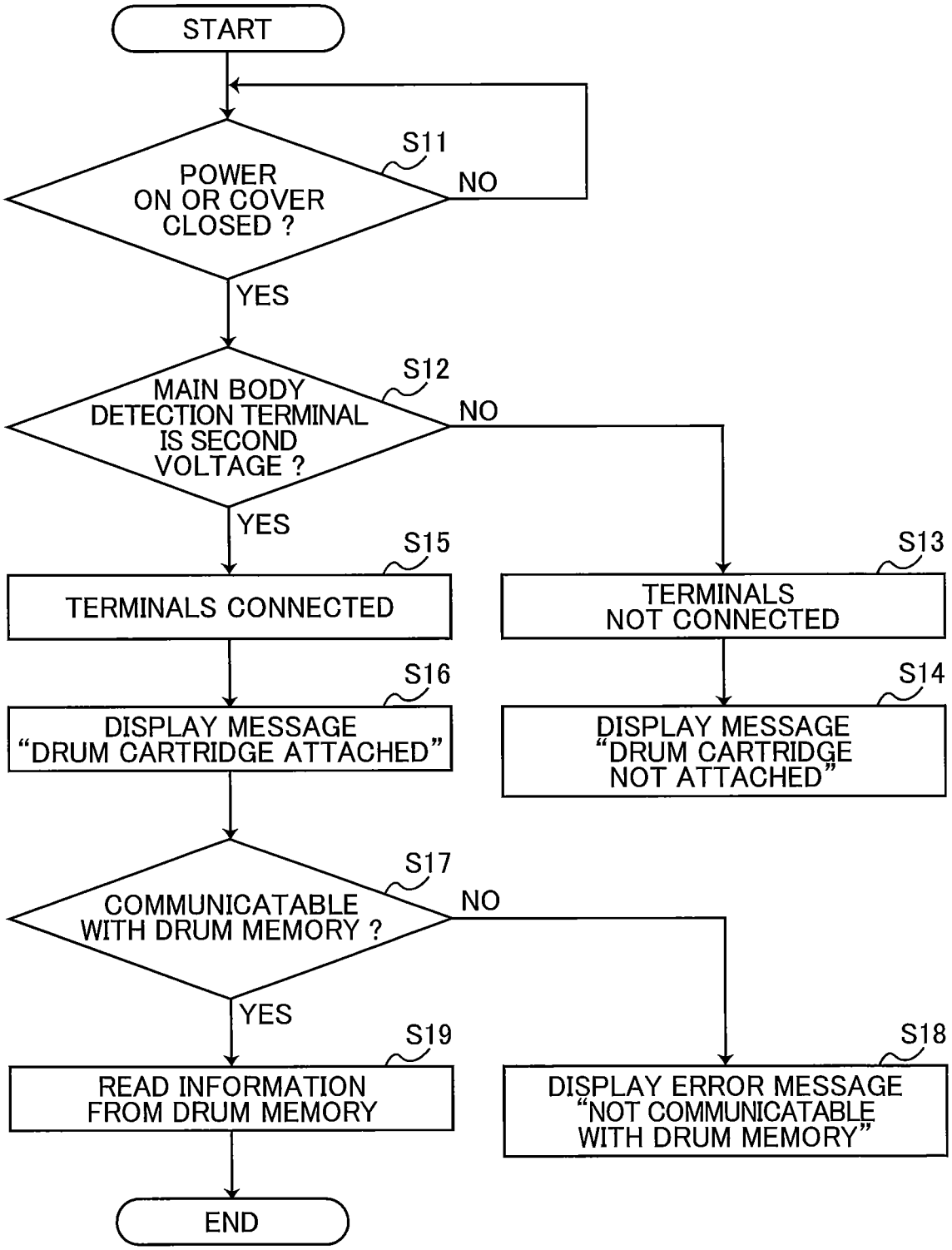
FIG. 7 is a flowchart illustrating a process for determining whether the drum cartridge is attached to the image forming apparatus.

Next, referring to the flow chart illustrated in FIG. 7, description will be made with the respect to a process in which the controller 102 of the image forming apparatus 100 determines whether the drum cartridge 1 is attached to the main body frame 101.

The controller 102 of the image forming apparatus 100 determines whether power is switched from OFF to ON or whether the cover 108 is moved from the open position to the closed position in a power-ON state (S11). The controller 102 determines that the cover 108 is moved from the open position to the closed position based on a detection signal from the sensor 109.

When the controller 102 determines that power is switched from OFF to ON or that the cover 108 is moved from the open position to the closed position in the power-ON state (S11; yes), the voltage measurement circuit 102*a* of the controller 102 measures the voltage value of the main body detection terminal 104*s*.

It is noted that in a case where the drum cartridge 1 is not attached to the main body frame 101, no current flows through the main body resistor 107. Thus, the voltage at the main body detection terminal 104*s* has the same potential with the potential of the first voltage at the main body voltage terminal 104*v*, which is connected to the main body detection terminal 104*s* through the main body resistor 107.

On the other hand, in a case where the drum cartridge 1 is attached to the main body frame 101, current flows from the main body voltage terminal 104*v* toward the main body ground terminal 104*g* through: the main body resistor 107; main body detection terminal 104*s*; drum detection terminal 31*s*; first drum resistor 331; and main body side drum ground terminal 31*g*. Thus, the voltage at the main body detection terminal 104*s*, which is positioned between the main body resistor 107 and the first drum resistor 331, becomes a second voltage that is lower than the first voltage and higher than the ground voltage.

Accordingly, the controller 102 determines whether the voltage at the main body detection terminal 104*s* measured by the voltage measurement circuit 102*a* is the first voltage or the second voltage (S12, first determination process). When determining that the voltage at the main body detection terminal 104*s* is the first voltage (S12: no), the controller 102 determines that the main body detection terminal 104*s* and the drum detection terminal 31*s* are not connected with each other (S13). That is, the controller 102 determines that the drum cartridge 1 is not attached to the main body frame 101.

Then, the controller 102 instructs the display 103 to display the result of the first determination process (S14, first display control processing). Specifically, the controller 102 instructs the display 103 to display a message indicating that the drum cartridge 1 is not attached to the main body frame 101.

On the other hand, when determining that the voltage at the main body detection terminal 104*s* measured by the voltage measurement circuit 102*a* is the second voltage (S12: yes), the controller 102 determines that the main body detection terminal 104*s* and the drum detection terminal 31*s* are connected with each other (step S15). That is, the controller 102 determines that the drum cartridge 1 is attached to the main body frame 101.

Then, the controller 102 instructs the display 103 to display the result of the first determination process (S16, first display control process). Specifically, the controller 102 instructs the display 103 to display a message indicating that the drum cartridge 1 is attached to the main body frame 101.

When determining in the first determination process that the main body detection terminal 104*s* and the drum detection terminal 31*s* are connected with each other, the controller 102 determines, after the first display control process, whether the controller is able to communicate with the information stored in the drum memory 151 (S17, second determination process). That is, the controller 102 determines whether the controller 102 is able to communicate with the information stored in the drum memory 151 through the main body data terminal 104*d* and the main body side drum data terminal 31*d*.

In the second determination process, the controller 102 transmits authentication information to the drum memory 151, for example. Then, when the controller 102 receives a response value from the drum memory 151, the controller 102 determines that the controller 102 is able to communicate with the information stored in the drum memory 151. On the other hand, when the controller 102 does not receive a response value from the drum memory 151, the controller 102 determines that the controller 102 is unable to communicate with the information stored in the drum memory 151.

When determining that the controller 102 is unable to communicate with the information stored in the drum memory 151 (S17: no), the controller 102 instructs the display 103 to display a determination result indicating that the controller 102 is unable to communicate with the information stored in the drum memory 151 (S18, second display control process). Specifically, the controller 102 instructs the display 103 to display a message indicating that the controller 102 is unable to communicate with information stored in the drum memory 151.

On the other hand, when determining that the controller is able to communicate with the information stored in the drum memory 151 (S17: yes), the controller 102 reads the information stored in the drum memory 151 through the main body side drum data terminal 31*d* and the main body data terminal 104*d* (S19). Specifically, the controller 102 reads, from the drum memory 151, at least one of information identifying the drum cartridge 1 and information indicating characteristics of the drum cartridge 1.

As described above, in the first determination process, the controller 102 of the image forming apparatus 100 can determine whether the main body detection terminal 104*s* and the drum detection terminal 31*s* are connected with each other based on a voltage at the main body detection terminal 104*s*. Further, in the first determination process, the controller 102 can determine whether the drum cartridge 1 is attached to the main body frame 101 based on whether the main body detection terminal 104*s* and the drum detection terminal 31*s* are connected with each other. Thus, the controller 102 can determine whether the drum cartridge 1 is attached to the main body frame 101 without communicating with the drum memory 151.

<7. Detection of Presence/Absence of Toner Cartridge>

Figure 8:
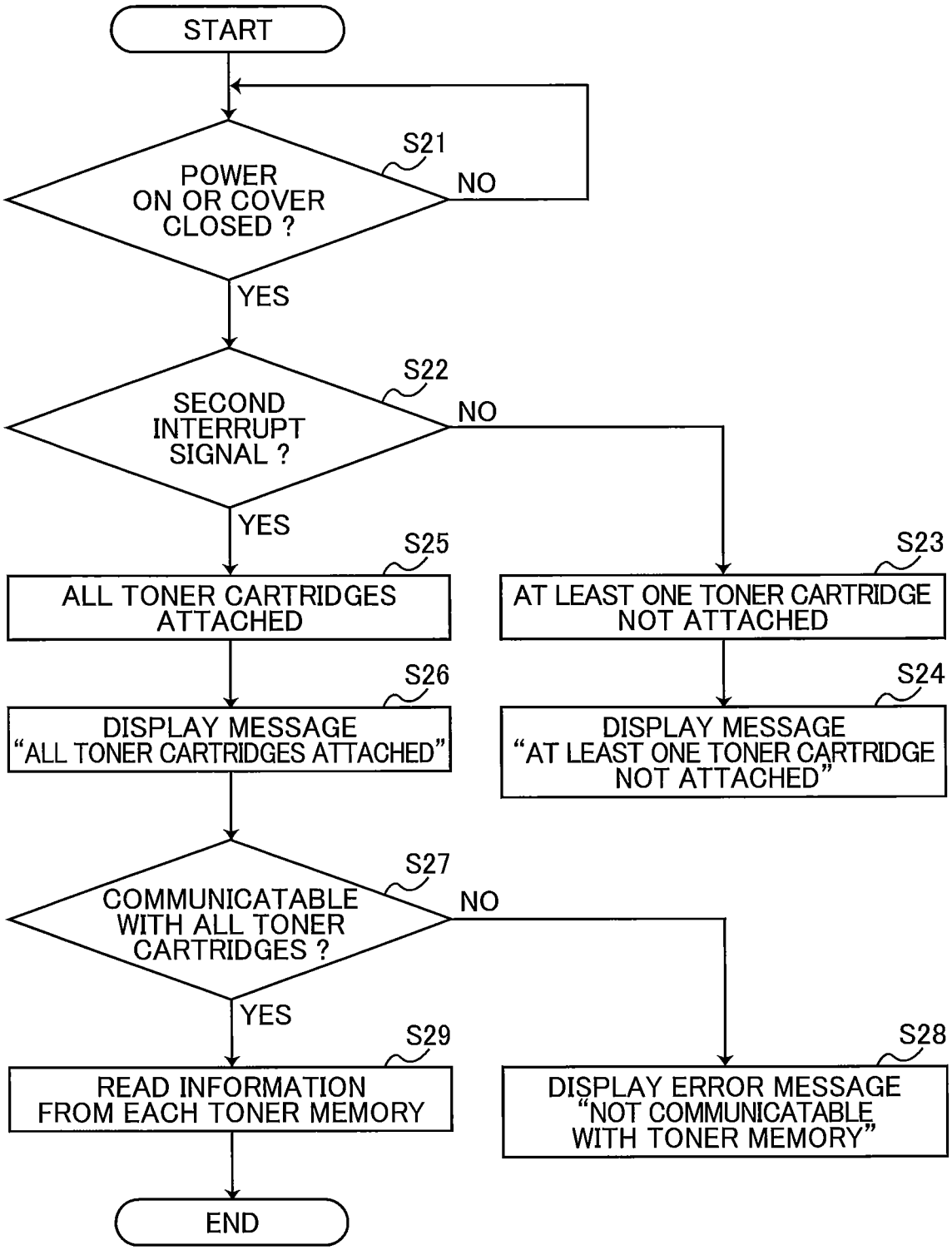
FIG. 8 is a flowchart illustrating a process for determining whether the toner cartridge is attached to the drum cartridge.

Next, referring to the flow chart illustrated in FIG. 8, description will be made with the respect to a process in which the controller 102 of the image forming apparatus 100 determines whether the toner cartridge 2 is attached to the drum frame 12.

The controller 102 of the image forming apparatus 100 determines whether power is switched from OFF to ON or whether the cover 108 is moved from the open position to the closed position in the power-ON state (S21). The controller 102 determines that the cover 108 is moved from the open position to the closed position based on a detection signal from the sensor 109.

When the controller 102 determines that power is switched from OFF to ON or that the cover 108 is moved from the open position to the closed position in the power-ON state (S21: yes), the signal detection circuit 102*b* of the controller 102 detects an interrupt signal received by the main body interrupt terminal 104*i*.

Here, a case where the toner cartridge 2 is not attached to the corresponding toner cartridge holder 121 of the drum frame 12 and a case where the toner cartridge 2 is attached to the corresponding toner cartridge holder 121 will be considered.

In the case where the toner cartridge 2 is not attached to the corresponding toner cartridge holder 121, the toner voltage terminal 242*v* of the toner cartridge 2 is not connected to the toner side drum voltage terminal 32*v* of the drum circuit board 15 and, similarly, the toner ground terminal 242*g* of the toner cartridge 2 is not connected to the toner side drum ground terminal 32*g* of the drum circuit board 15, and the toner data terminal 242*d* of the toner cartridge 2 is not connected to the toner side drum data terminal 32*d* of the drum circuit board 15. Therefore, no current flows through the second drum resistor 332 connected to the toner side drum data terminal 32*d*. Thus, the voltage at the toner side drum data terminal 32*d* becomes the same potential as the potential of the ground voltage at the main body side drum ground terminal 31*g*, which is connected to the toner side drum data terminal 32*d* through the second drum resistor 332. The ground voltage at the toner side drum data terminal 32*d* is input to the interrupt input port 341 of the multiplexer 34.

On the other hand, in the case where the toner cartridge 2 is attached to the toner cartridge holder 121, the toner voltage terminal 242*v* of the toner cartridge 2 is connected to the toner side drum voltage terminal 32*v* of the drum circuit board 15. The toner ground terminal 242*g* of the toner cartridge 2 is connected to the toner side drum ground terminal 32*g* of the drum circuit board 15. The toner data terminal 242*d* of the toner cartridge 2 is connected to the toner side drum data terminal 32*d* of the drum circuit board 15. Therefore, current flows from the main body voltage terminal 104*v* toward the main body ground terminal 104*g* through: the main body side drum voltage terminal 31*v*; toner side drum voltage terminal 32*v*; toner voltage terminal 242*v*; toner resistor 243; toner data terminal 242*d*; toner side drum data terminal 32*d*; second drum resistor 332; and main body side drum ground terminal 31*g*. Thus, the voltage at the toner side drum data terminal 32*d*, which is positioned between the toner resistor 243 and the second drum resistor 332, becomes the second voltage that is lower than the first voltage and higher than the ground voltage. The second voltage at the toner side drum data terminal 32*d* is input to the interrupt input port 341 of the multiplexer 34. In other words, the first voltage supplied from the main body voltage terminal 104*v* is dropped by the toner resistor 243 to become the second voltage, which in turn is input to the interrupt input port 341 of the multiplexer 34.

Thus, when at least one of the four toner cartridge holders 121 is attached with no toner cartridge 2, the ground voltage is input to at least one of the four interrupt input ports 341 of the multiplexer 34. In this case, the multiplexer 34 outputs the first interrupt signal from the interrupt output port 342 to the main body interrupt terminal 104*i* through the drum interrupt terminal 31*i*.

On the other hand, when all the four toner cartridge holders 121 are attached with the toner cartridges 2, the second voltage is input to all the four interrupt input ports 341 of the multiplexer 34. In this case, the multiplexer 34 outputs the second interrupt signal, whose voltage value is different from that of the first interrupt signal, from the interrupt output port 342 to the main body interrupt terminal 104*i* through the drum interrupt terminal 31*i*.

Accordingly, the controller 102 determines whether the interrupt signal detected by the signal detection circuit 102*b* is the first interrupt signal or second interrupt signal (S22, third determination process). In other words, the controller 102 determines whether the main body voltage terminal 104*v* and the toner voltage terminal 242*v* are electrically connected with each other via the main body side drum voltage terminal 31*v* and the toner side drum voltage terminal 32*v*. When determining that the interrupt signal detected by the signal detection circuit 102*b* is the first interrupt signal (S22: no), the controller 102 determines that at least one of the toner cartridge holders 121 in the drum frame 12 is attached with no toner cartridge 2 (S23).

Then, the controller 102 instructs the display 103 to display the result of the third determination process (S24, third display control process). Specifically, the controller 102 instructs the display 103 to display a message (first error message) indicating that at least one toner cartridge holder 121 of the drum frame 12 is attached with no toner cartridge 2.

On the other hand, when determining, in the third determination process, that the interrupt signal detected by the signal detection circuit 102*b* is the second interrupt signal (S22: yes), the controller 102 determines that all the toner cartridge holders 121 of the drum frame 12 are attached with the toner cartridges 2 (S25).

Then, the controller 102 instructs the display 103 to display the result of the third determination process (S26, third display control process). Specifically, the controller 102 instructs the display 103 to display a message indicating that all the toner cartridge holders 121 of the drum frame 12 are attached with the toner cartridges 2.

When determining, in the third determination process, that all the toner cartridge holders 121 of the drum frame 12 are attached with the toner cartridges 2, the controller 102 determines, after the third display control process, whether the controller 102 is able to communicate with the information stored in all of the four toner memories 24 (S27, fourth determination process). That is, the controller 102 determines whether the controller 102 is able to communicate with information stored in the toner memories 24 through the drum circuit board 15.

In the fourth determination process, the controller 102 transmits authentication information to each of the four toner memories 24, for example. Then, when the controller 102 receives a response value from each of the four toner memories 24, the controller 102 determines that the controller 102 is able to communicate with the information stored in each of the four toner memories 24. On the other hand, when the controller 102 receives no response value from at least one toner memory 24, the controller 102 determines that the controller 102 is unable to communicate with the information stored in the at least one toner memory 24.

When determining that the controller 102 is unable to communicate with the information stored in the at least one toner memory 24 (S27: no), the controller 102 instructs the display 103 to display a determination result indicating that the controller 102 is unable to communicate with the information stored in at least one toner memory 24 (S28, fourth display control process). Specifically, the controller 102 instructs the display 103 to display a message (second error message) indicating that the controller 102 is unable to communicate with information stored in at least one toner memory 24.

On the other hand, when determining that the controller 102 is able to communicate with the information stored in all of the four toner memories 24 (S27: yes), the controller 102 reads information stored in each of the four toner memories 24 through the drum circuit board 15 (S29). Specifically, the controller 102 reads, from the toner memory 24 of each toner cartridge 2, at least one of information for identifying the toner cartridge 2 and information indicating characteristics of the toner cartridge 2.

As described above, in the third determination process, the controller 102 of the image forming apparatus 100 determines that the toner cartridge 2 is not attached to the toner cartridge holder 121 of the drum frame 12 when the second voltage is not supplied to the interrupt input port 341 of the multiplexer 34 through the toner memory 24 in the state where the interrupt input port 341 of the multiplexer 34 is electrically connected to the main body ground terminal 104*g*. Further, in the third determination process, the controller 102 determines that the toner cartridge 2 is attached to the toner cartridge holder 121 of the drum frame 12 when the second voltage is supplied to the interrupt input port 341 of the multiplexer 34 through the toner memory 24.

Thus, the controller 102 can determine whether the toner cartridge 2 is attached to the drum frame 12 without transmitting and receiving data with the toner memory 24.

Further, in the image forming apparatus 100, the multiplexer 34 outputs the first interrupt signal to the controller 102 when the second voltage is not supplied to the interrupt input port 341 of the multiplexer 34 through the toner memory 24 in the state where the interrupt input port 341 of the multiplexer 34 is electrically connected to the main body ground terminal 104*g*. Further, in the image forming apparatus 100, the multiplexer 34 outputs the second interrupt signal to the controller 102 when the second voltage is supplied to the interrupt input port 341 of the multiplexer 34 through the toner memory 24.

Thus, when the first interrupt signal is output from the multiplexer 34, the controller 102 can determine that the toner cartridge 2 is not attached to the toner cartridge holder 121 of the drum frame 12. On the other hand, when the second interrupt signal is output from the multiplexer 34, the controller 102 can determine that the toner cartridge 2 is attached to the toner cartridge holder 121 of the drum frame 12.

Further, the controller 102 of the image forming apparatus 100 determines that at least one toner cartridge holder 121 of the drum frame 12 is attached with no toner cartridge 2 when the second voltage is not supplied to the interrupt input port 341 of the multiplexer 34 through at least one of the plurality of toner memories 24 in the state where the interrupt input port 341 of the multiplexer 34 is electrically connected to the main body ground terminal 104*g*. Further, the controller 102 determines that all the toner cartridge holders 121 of the drum frame 12 are attached with the toner cartridges 2 when the second voltages are supplied to all the plurality of interrupt input ports 341 of the multiplexer 34 through the toner memories 24. As described above, the controller 102 can determine whether all the toner cartridge holders 121 of the drum frame 12 are attached with the toner cartridges 2.

Further, the controller 102 of the image forming apparatus 100 instructs the display 103 to display messages such that the contents of the messages are different in the case where the toner cartridge holder 121 is attached with no toner cartridge 2 and in the case where the controller 102 is unable to communicate with the toner memory 24 of the toner cartridge 2 attached to the toner cartridge holder 121. This allows the controller to display an error state in more detail.

<8. Modifications>

While the one embodiment has been described above, the present disclosure is not limited to the above-described embodiment. Hereinafter, various modifications will be described focusing on differences from the above-described embodiment.

<8-1. First Modification>

Figure 9:
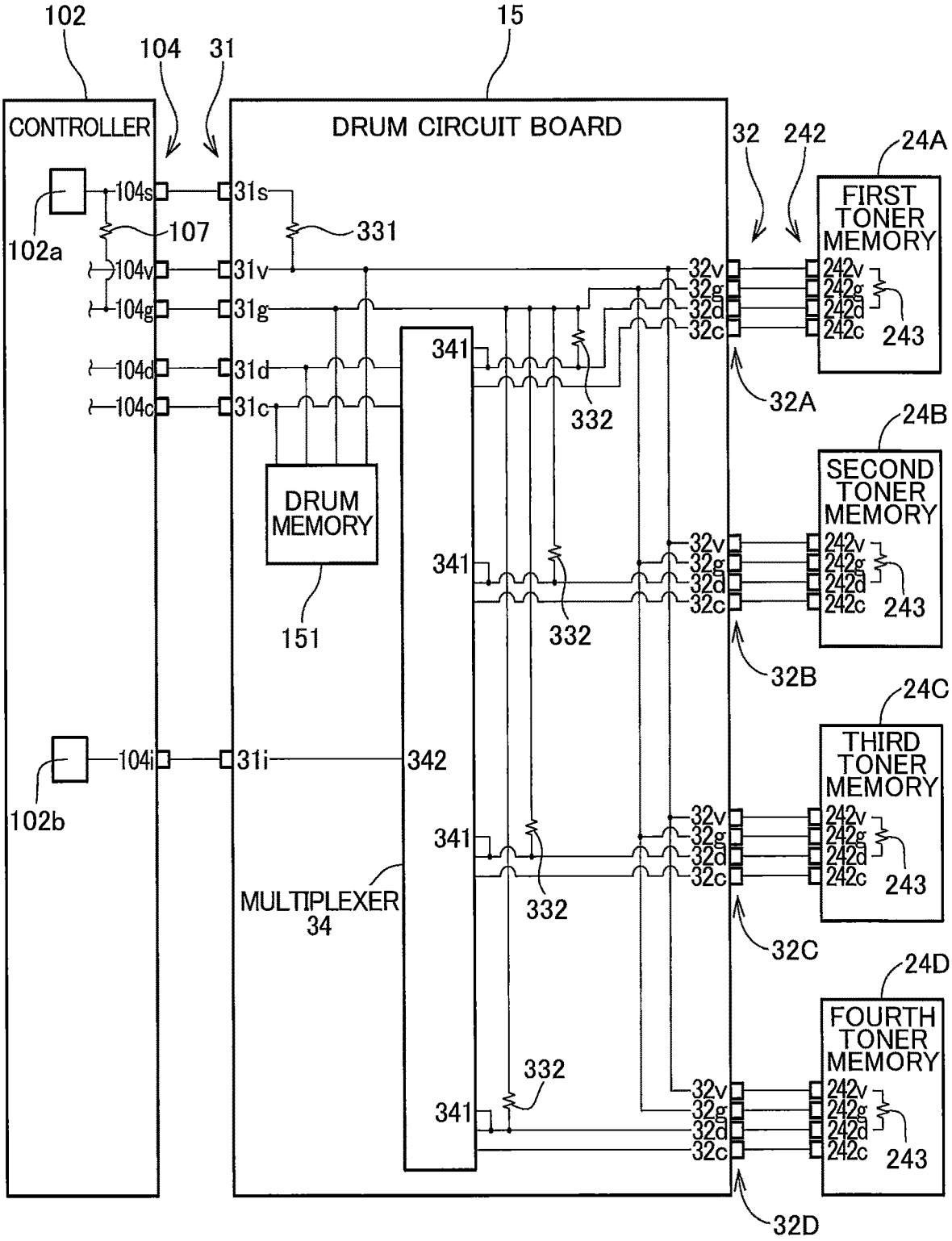
FIG. 9 is a block diagram showing an electrical connection among the controller, the drum circuit board, and the toner memory according to a first modification.

FIG. 9 is a block diagram illustrating electrical connection between the controller 102, the drum circuit board 15, and the toner memory 24 according to a first modification. The first modification differs from the above embodiment in the manner how the main body resistor 107 and the first drum resistor 331 are connected to other components.

The main body resistor 107 according to the first modification is configured such that the main body resistor 107 has one end connected to the main body detection terminal 104*s* and another end connected to the main body ground terminal 104*g*. The first drum resistor 331 according to the first modification is configured such that the drum resistor 331 has one end connected to the drum detection terminal 31*s* and another end connected to the main body side drum voltage terminal 31*v*.

When the drum cartridge 1 is not attached to the main body frame 101, no current flows through the main body resistor 107. Thus, the voltage at the main body detection terminal 104*s* has the same potential as the potential of the ground voltage at the main body ground terminal 104*g*, which is connected to the main body detection terminal 104*s* through the main body resistor 107.

On the other hand, when the drum cartridge 1 is attached to the main body frame 101, current flows from the main body voltage terminal 104*v* toward the main body ground terminal 104*g* through: the main body side drum voltage terminal 31*v*; first drum resistor 331; drum detection terminal 31*s*; main body detection terminal 104*s*; and main body resistor 107. Thus, the voltage at the main body detection terminal 104*s*, which is positioned between the first drum resistor 331 and the main body resistor 107, becomes the second voltage that is lower than the first voltage and higher than the ground voltage.

In the first determination process, the controller 102 determines whether the voltage at the main body detection terminal 104*s* measured by the voltage measurement circuit 102*a* is the ground voltage or second voltage. When determining that the voltage at the main body detection terminal 104*s* is the ground voltage, the controller 102 determines that the main body detection terminal 104*s* and the drum detection terminal 31*s* are not connected with each other. That is, the controller 102 determines that the drum cartridge 1 is not attached to the main body frame 101.

On the other hand, when determining, in the first determination process, that the voltage at the main body detection terminal 104*s* is the second voltage, the controller 102 determines that the main body detection terminal 104*s* and the drum detection terminal 31*s* are connected with each other. That is, the controller 102 determines that the drum cartridge 1 is attached to the main body frame 101.

In this first modification as well as the above-described embodiment, the controller 102 can determine whether the drum cartridge 1 is attached to the main body frame 101 based on the voltage at the main body detection terminal 104*s*. Thus, the controller 102 can determine whether the drum cartridge 1 is attached to the main body frame 101 without exchanging data with the drum memory 151.

<8-2. Second Modification>

Figure 10:
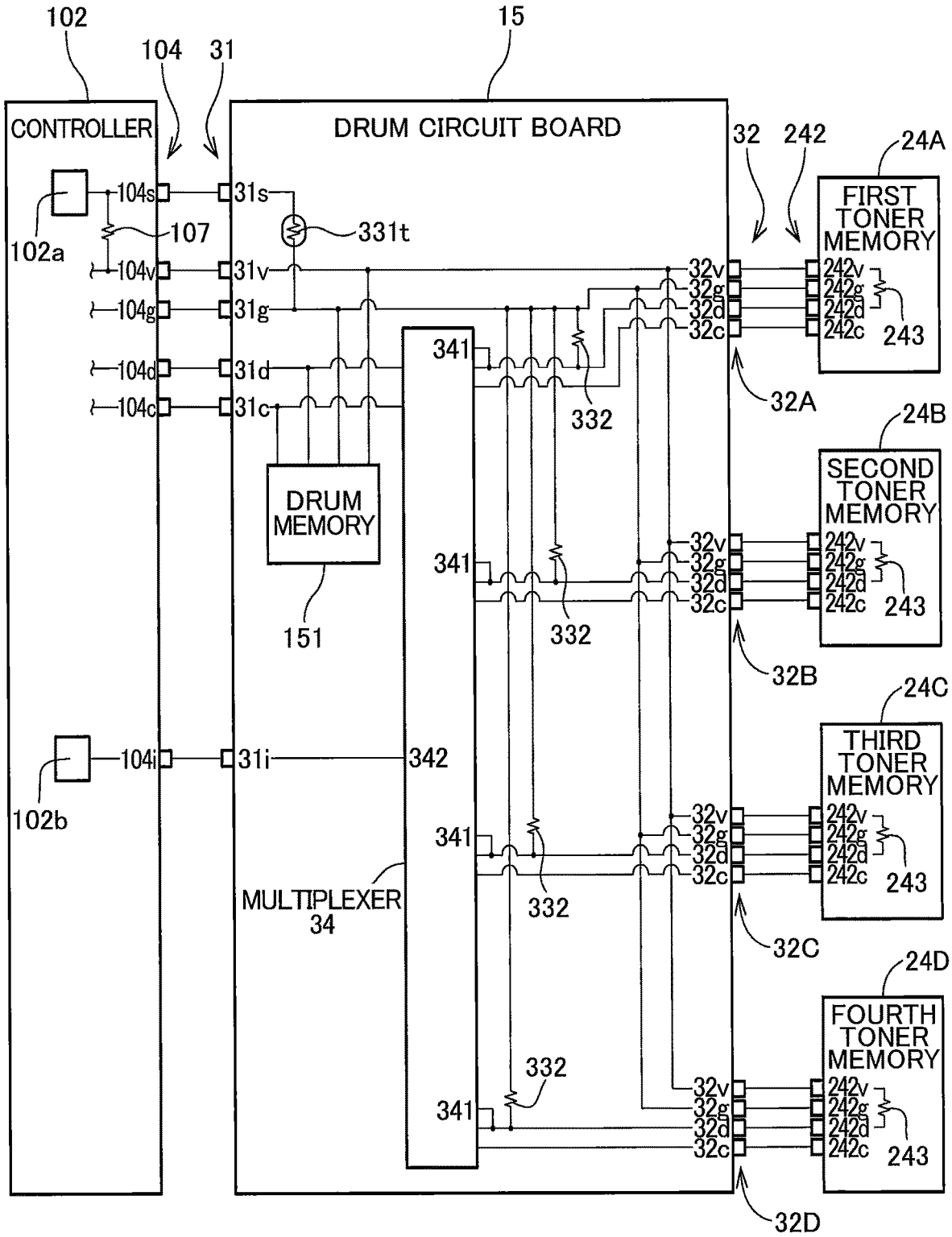
FIG. 10 is a block diagram showing an electrical connection among the controller, the drum circuit board, and the toner memory according to a second modification.

FIG. 10 is a block diagram illustrating electrical connection between the controller 102, the drum circuit board 15, and the toner memories 24 according to a second modification. The second modification differs from the above-described embodiment in that a thermistor 331*t* is used as the first drum resistor 331.

The thermistor 331*t* is a temperature sensor including an electric resistor. The resistance value of the thermistor 331*t* changes according to the temperature. The thermistor 331*t* has one end connected to the drum detection terminal 31*s* and another end connected to the main body side drum ground terminal 31*g*. Thus, the controller 102 can determine whether the drum cartridge 1 is attached to the main body frame 101 by performing the first determination process in the same manner as in the above-described embodiment.

Further, in this second modification, the resistance value of the thermistor 331*t* changes according to the temperature. Thus, when the drum cartridge 1 is attached to the main body frame 101, the value of the second voltage at the main body detection terminal 104*s* also changes according to the temperature. This allows the controller 102 to detect the temperature inside the main body frame 101 based on the value of the second voltage measured by the voltage measurement circuit 102*a*.

In the second modification, the thermistor 331*t* serves both as the first drum resistor 331 and the temperature sensor. This eliminates the need to separately provide the first drum resistor 331 and the temperature sensor, allowing reduction in the number of components in the drum circuit board 15.

<8-3. Third Modification>

Figure 11:
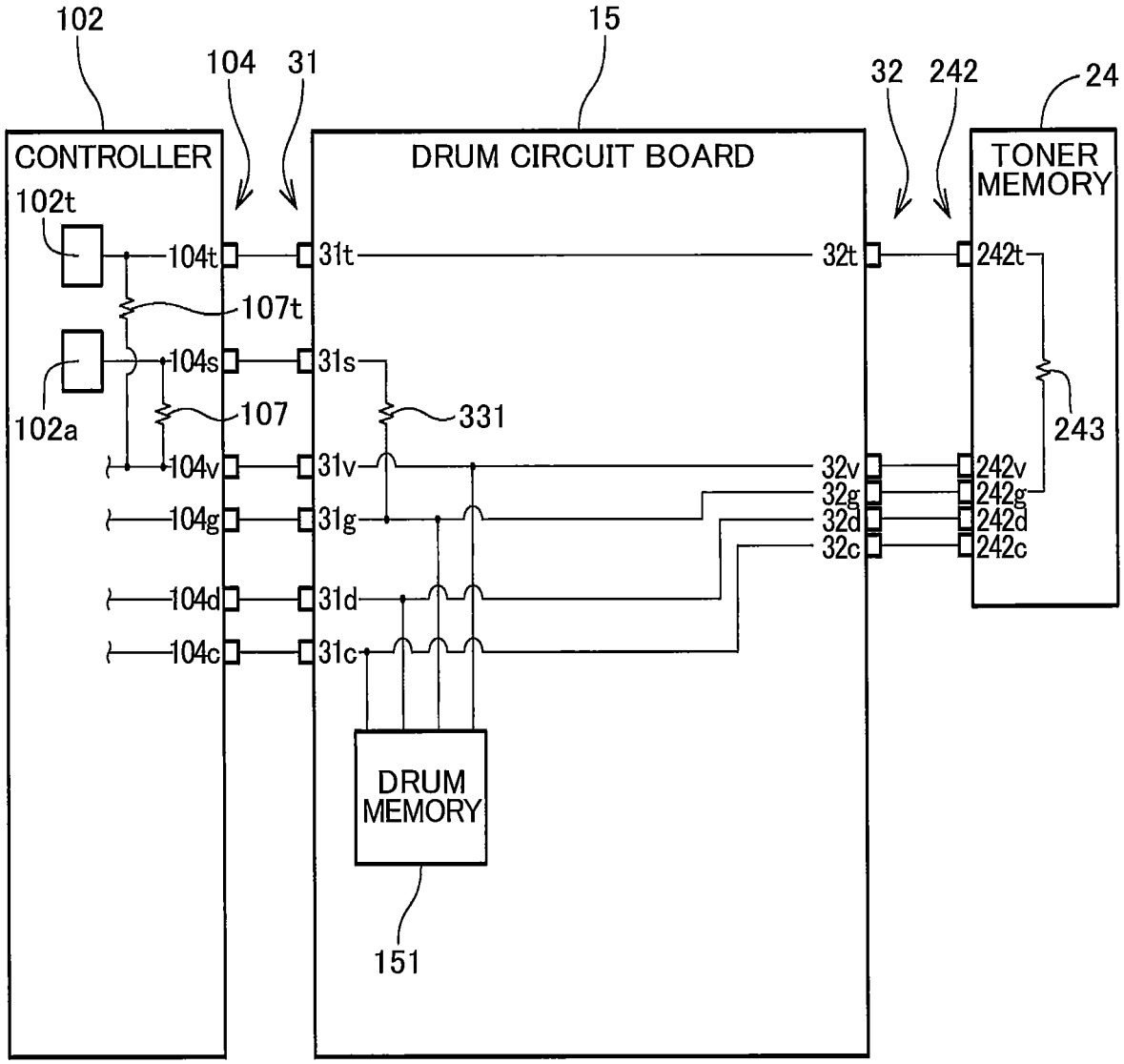
FIG. 11 is a block diagram showing an electrical connection among the controller, the drum circuit board, and the toner memory according to a third modification.

FIG. 11 is a block diagram illustrating electrical connection between the controller 102, the drum circuit board 15, and one toner memory 24 according to a third modification. The third modification differs from the above-described embodiment in the following respects: the number of the toner cartridges 2 that can be attached to the drum frame 12 is one; the controller 102 has a second main body resistor 107*t*, a second main body detection terminal 104*t*, and a second voltage measurement circuit 102*t*; the drum circuit board 15 has a main body side drum detection terminal 31*t* and a toner side drum detection terminal 32*t*; and the toner memory 24 has a toner detection terminal 242*t*.

The second main body resistor 107*t* has one end connected to the second main body detection terminal 104*t* and another end connected to the main body voltage terminal 104*v*. The main body side drum detection terminal 31*t* is electrically connected to the second main body detection terminal 104*t* in the state where the drum cartridge 1 is attached to the main body frame 101 of the image forming apparatus 100. The toner side drum detection terminal 32*t* is electrically connected to the main body side drum detection terminal 31*t*. The toner detection terminal (cartridge detection terminal) 242*t* is electrically connected to the toner side drum detection terminal 32*t* in the state where the toner cartridge 2 is attached to the drum frame 12. The toner resistor 243 (cartridge resistor) has one end connected to the toner detection terminal 242*t* and another end connected to the toner ground terminal 242*g*. The second voltage measurement circuit 102*t* can measure the voltage at the second main body detection terminal 104*t*.

When the toner cartridge 2 is not attached to the drum frame 12, no current flows through the second main body resistor 107*t*. Thus, the voltage at the second main body detection terminal 104*t* has the same potential as the first voltage at the main body voltage terminal 104*v*, which is connected to the main body detection terminal 104*t* through the main body resistor 107.

On the other hand, when the toner cartridge 2 is attached to the drum frame 12, current flows from the main body voltage terminal 104*v* toward the main body ground terminal 104*g* through: the second main body resistor 107*t*; second main body detection terminal 104*t*; main body side drum detection terminal 31*t*; toner side drum detection terminal 32*t*; toner detection terminal 242*t*; toner resistor 243; toner ground terminal 242*g*; toner side drum ground terminal 32*g*; and main body side drum ground terminal 31*g*. Thus, the voltage at the second main body detection terminal 104*t*, which is positioned between the second main body resistor

107*t* and the toner resistor 243, is the second voltage that is lower than the first voltage and higher than the ground voltage.

In the third determination process, the controller 102 determines whether the voltage at the second main body detection terminal 104*t* measured by the second voltage measurement circuit 102*t* is the first voltage or second voltage. That is, the controller 102 determines, in S22, whether the voltage at the second main body detection terminal 104*t* measured by the second voltage measurement circuit 102*t* is the first voltage or second voltage. In other words, the controller 102 determines whether the main body detection terminal 104*t* and the toner detection terminal 242*t* are electrically connected with each other via the main body side drum detection terminal 31*t* and the toner side drum detection terminal 32*t*. When determining that the voltage at the second main body detection terminal 104*t* is the first voltage, the controller 102 determines that the toner side drum detection terminal 32*t* and the toner detection terminal 242*t* are not connected with each other. That is, the controller 102 determines that the toner cartridge 2 is not attached to the drum frame 12.

On the other hand, when determining, in the third determination process, that the voltage at the second main body detection terminal 104*t* measured by the second voltage measurement circuit 102*t* is the second voltage, the controller 102 determines that the toner side drum detection terminal 32*t* and the toner detection terminal 242*t* are connected with each other. That is, the controller 102 determines that the toner cartridge 2 is attached to the drum frame 12.

As described above, in the third determination process, the controller 102 of the image forming apparatus 100 can determine whether the toner side drum detection terminal 32*t* and the toner detection terminal 242*t* are connected with each other based on the amount of the voltage at the second main body detection terminal 104*t*. Further, in the third determination process, the controller 102 can determine whether the toner cartridge 2 is attached to the drum frame 12 based on whether the toner side drum detection terminal 32*t* and the toner detection terminal 242*t* are connected with each other. Thus, the controller 102 can determine whether the toner cartridge 2 is attached to the drum frame 12 without communicating with the toner memory 24.

<8-4. Fourth Modification>

Figure 12:
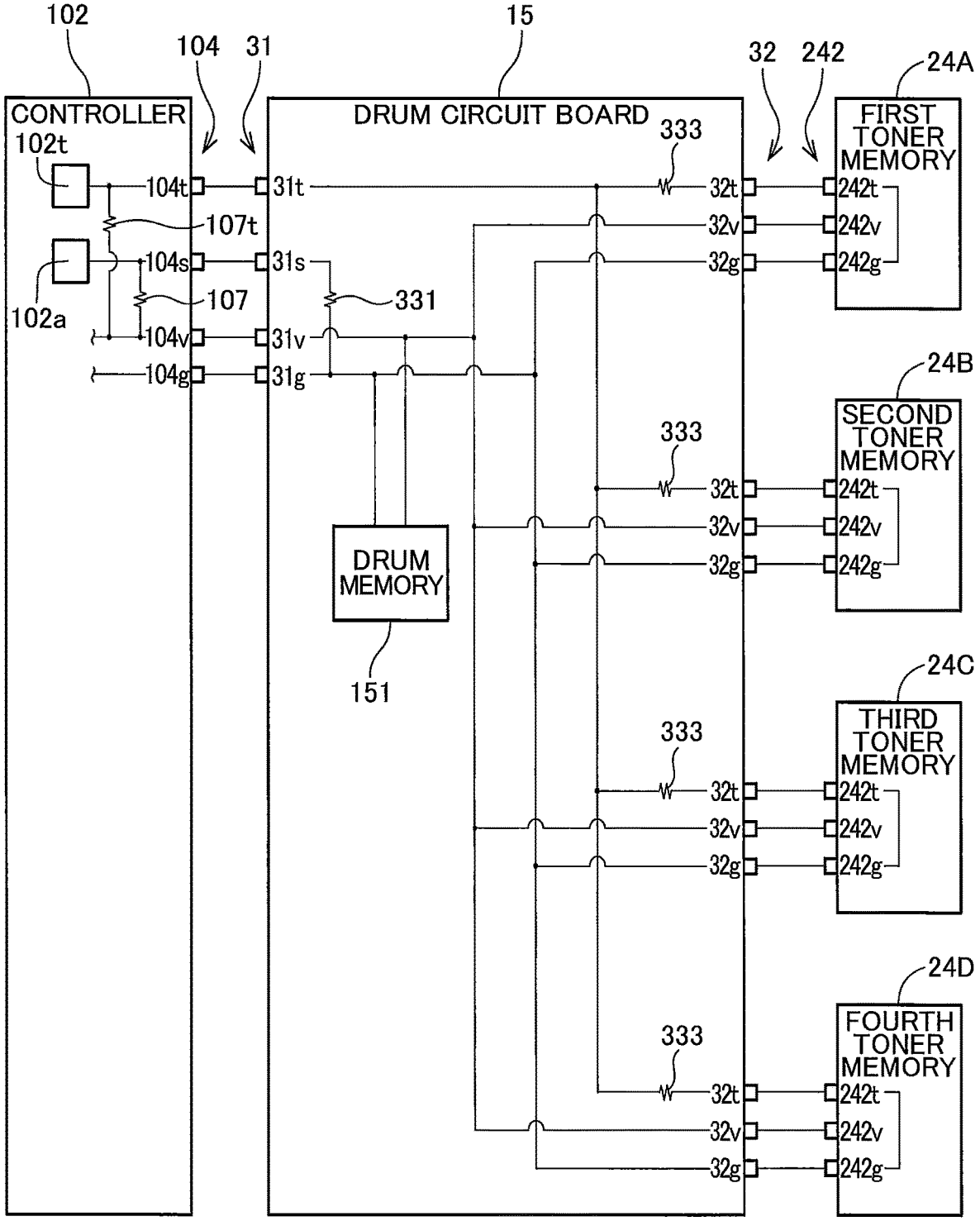
FIG. 12 is a block diagram showing an electrical connection among the controller, the drum circuit board, and the toner memory according to a fourth modification.

FIG. 12 is a block diagram illustrating electrical connection between the controller 102, the drum circuit board 15, and the toner memories 24 according to a fourth modification. In FIG. 12, showing of the data terminals and clock terminals is omitted. The fourth modification differs from the above-described embodiment in the following respects: the controller 102 has a second main body resistor 107*t*, a second main body detection terminal 104*t*, and a second voltage measurement circuit 102*t*; the drum circuit board 15 has a main body side drum detection terminal 31*t*, four toner side drum detection terminals 32*t*, and four third drum resistors 333; and each of the toner memories 24 has a toner detection terminal 242*t*.

The resistor 107*t* has one end connected to the second main body detection terminal 104*t* and another end connected to the main body voltage terminal 104*v*. The main body side drum detection terminal 3 it is electrically connected to the second main body detection terminal 104*t* in the state where the drum cartridge 1 is attached to the main body frame 101 of the image forming apparatus 100. The four third drum resistors 333 are connected in parallel. One end of each of the four third drum resistors 333 is connected to the main body side drum detection terminal 31*t*, and the other end thereof is connected to the corresponding toner side drum detection terminal 32*t*. In each toner memory, the toner detection terminal (cartridge detection terminal) 242*t* is electrically connected to the toner side drum detection terminal 32*t* in the state where the toner cartridge 2 is attached to the drum frame 12. Further, the toner detection terminal 242*t* is electrically connected to the toner ground terminal 242*g*. The second voltage measurement circuit 102*t* can measure the voltage at the second main body detection terminal 104*t*.

When no toner cartridge 2 is attached to the drum frame 12, no current flows through the second main body resistor 107*t*. Thus, the voltage at the second main body detection terminal 104*t* has the same potential as the first voltage at the main body voltage terminal 104*v*, which is connected to the second main body detection terminal 104*t* through the main body resistor 107.

On the other hand, when at least one toner cartridge 2 is attached to the drum frame 12, current flows from the main body voltage terminal 104*v* toward the main body ground terminal 104*g* through: the second main body resistor 107*t*; second main body detection terminal 104*t*; main body side drum detection terminal 3 it; one of the third drum resistors 333 that is connected to the toner memory 24 of the attached toner cartridge 2; toner side drum detection terminal 32*t*; toner detection terminal 242*t*; toner ground terminal 242*g*; toner side drum ground terminal 32*g*; and main body side drum ground terminal 31*g*. Thus, the voltage at the second main body detection terminal 104*t*, which is positioned between the second main body resistor 107*t* and the third drum resistor 333, becomes the second voltage that is lower than the first voltage and higher than the ground voltage.

In the fourth modification, resistance values of the four third drum resistors 333 differ from one another. Further, resultant resistance values of parallel combinations of any two, three or four of the four third drum resistors 333 differ from one another. With such a configuration, the voltage value of the second voltage changes depending on a combination of the third drum resistors 333, through which current flows.

In the third determination process, the controller 102 determines whether the voltage at the second main body detection terminal 104*t* measured by the second voltage measurement circuit 102*t* is the first voltage or second voltage. That is, the controller 102 determines, in S22, whether the voltage at the second main body detection terminal 104*t* measured by the second voltage measurement circuit 102*t* is the first voltage or second voltage. In other words, the controller 102 determines whether the main body detection terminal 104*t* and the toner detection terminal 242*t* are electrically connected with each other via the main body side drum detection terminal 31*t* and the toner side drum detection terminal 32*t*. When determining that the voltage at the second main body detection terminal 104*t* is the first voltage, the controller 102 determines that none of the toner side drum detection terminals 32*t* of the drum circuit board 15 are connected with the toner detection terminal 242*t*. That is, the controller 102 determines that the drum frames 12 is attached with no toner cartridges 2.

On the other hand, when determining, in the third determination process, that the voltage at the second main body detection terminal 104*t* measured by the second voltage measurement circuit 102*t* is the second voltage, the controller 102 determines that at least one of the toner side drum detection terminals 32*t* of the drum circuit board 15 is connected with the toner detection terminal 242*t*. That is, the controller 102 determines that at least one toner cartridge 2 is attached to the drum frame 12.

In this case, the controller 102 further determines a combination of the attached toner cartridges 2 based on the voltage value of the second voltage. Specifically, the correspondence relationship between a plurality of combinations of the toner cartridges 2 to be attached and voltage values of the second voltage are previously stored in the main body memory 106 of the controller 102. The controller 102 determines, in the third determination process, a combination of the attached toner cartridges 2 based on the voltage value of the second voltage measured by the second voltage measurement circuit 102*t* and the correspondence relationship read from the main body memory 106.

<8-5. Other Modifications>

The structures, the circuit configurations and processing procedures in the above-described embodiments and modifications are merely examples. Various elements appearing in the above-described embodiments and modifications may be replaced with other known elements without departing from the scope of the disclosure. Further, various elements appearing in the above-described embodiments and modifications may be appropriately combined within a range in which inconsistency does not occur.

While the description has been made in detail with reference to the specific embodiment, it would be apparent to those skilled in the art that various changes and modifications may be made without departing from the scope of the disclosure.

For example, the first drum resistor 331 in the first modification (FIG. 9) may be replaced with a thermistor 331*t* as in the second modification (FIG. 10).

What is claimed is:

1. An image forming apparatus comprising:

a controller;

a main body frame;

a drum cartridge attachable to the main body frame, the drum cartridge comprising:

a memory storing information related to the drum cartridge;

a cartridge data terminal configured to communicate the information stored in the memory; and one or more cartridge terminals including a cartridge detection terminal; and a display, wherein the controller includes:

a main body data terminal electrically connected to the cartridge data terminal in a case where the drum cartridge is attached to the main body frame; and one or more main body terminals including a main body detection terminal, the main body detection terminal being electrically connected to the cartridge detection terminal in the case where the drum cartridge is attached to the main body frame, and wherein the controller is configured to perform:

determining whether the main body detection terminal and the cartridge detection terminal are electrically connected with each other;

determining a connection status of a toner cartridge to the drum cartridge based on a connection between a specific cartridge terminal included in the one or more cartridge terminals and a specific main body terminal included in the one or more main body terminals;

displaying a determination result of the determining whether the main body detection terminal and the cartridge detection terminal are electrically connected with each other on the display; and displaying a message on the display indicating the connection status of the toner cartridge to the drum cartridge.

2. The image forming apparatus according to claim 1, wherein the drum cartridge further comprises a circuit board, and wherein the circuit board comprises the memory, the cartridge data terminal and the cartridge detection terminal, the cartridge data terminal being electrically connected to the memory.

3. The image forming apparatus according to claim 1, wherein the controller is configured such that in a case where the controller determines that the main body detection terminal and the cartridge detection terminal are electrically connected with each other, the controller instructs the display to display a message indicating that the drum cartridge is attached to the main body frame when the controller determines whether the main body detection terminal and the cartridge detection terminal are electrically connected with each other.

4. The image forming apparatus according to claim 1, wherein the controller is configured such that in a case where the controller determines that the main body detection terminal and the cartridge detection terminal are not electrically connected with each other, the controller instructs the display to display a message indicating that the drum cartridge is not attached to the main body frame when the controller determines whether the main body detection terminal and the cartridge detection terminal are electrically connected with each other.

5. The image forming apparatus according to claim 1, wherein the controller is further configured to perform:

determining whether the controller is capable of communicating with the information stored in the memory through the main body data terminal in a case where the controller determines that the main body detection terminal and the cartridge detection terminal are electrically connected with each other; and displaying a message indicating that the controller is unable to communicate with the information stored in the memory on the display in a case where the controller determines that the controller is unable to communicate with the information stored in the memory through the main body data terminal.

6. The image forming apparatus according to claim 1, wherein the drum cartridge further comprises:

a cartridge voltage terminal electrically connected to the memory;

a cartridge ground terminal electrically connected to the memory; and a resistor having one end and another end, the one end being electrically connected to the cartridge detection terminal, the another end being electrically connected to the cartridge ground terminal, wherein the controller further includes:

a main body voltage terminal electrically connected to the controller and supplying a first voltage to the cartridge voltage terminal, the main body voltage terminal being electrically connected to the cartridge voltage terminal in the case where the drum cartridge is attached to the main body frame;

a main body ground terminal electrically connected to the cartridge ground terminal in the case where the drum cartridge is attached to the main body frame; and a main body resistor having one end and another end, the one end of the main body resistor being connected to the main body detection terminal, the another end of the main body resistor being connected to the main body voltage terminal, wherein the main body detection terminal and the main body voltage terminal are connected with each other through the main body resistor, thereby causing a voltage at the main body detection terminal to have the same potential as the first voltage at the main body voltage terminal in the case where the drum cartridge is not attached to the main body frame, wherein, in the case where the drum cartridge is attached to the main body frame, current flows from the main body voltage terminal toward the main body ground terminal through the main body resistor, the main body detection terminal, cartridge detection terminal, cartridge resistor, and the cartridge ground terminal, so that the voltage at the main body detection terminal, which is positioned between the main body resistor and the cartridge resistor, becomes a second voltage that is lower than the first voltage and higher than the ground voltage, and wherein, when the controller determines whether the main body detection terminal and the cartridge detection terminal are electrically connected with each other, the controller is configured to perform:

determining that the main body detection terminal and the cartridge detection terminal are not connected with each other in a case where the voltage of the main body detection terminal is the first voltage; and determining that the main body detection terminal and the cartridge detection terminal are connected with each other in a case where the voltage of the main body detection terminal is the second voltage.

7. The image forming apparatus according to claim 1, wherein the drum cartridge further comprises:

a cartridge voltage terminal electrically connected to the memory;

a cartridge ground terminal electrically connected to the memory; and a resistor having one end and another end, the one end being electrically connected to the cartridge detection terminal, the another end being electrically connected to the cartridge voltage terminal, wherein the controller further includes:

a main body voltage terminal electrically connected to the controller and supplying a first voltage to the cartridge voltage terminal, the main body voltage terminal being electrically connected to the cartridge voltage terminal in the case where the drum cartridge is attached to the main body frame;

a main body ground terminal electrically connected to the cartridge ground terminal in the case where the drum cartridge is attached to the main body frame; and a main body resistor having one end and another end, the one end of the main body resistor being connected to the main body detection terminal, the another end of the main body resistor being connected to the main body ground terminal, wherein the voltage at the main body detection terminal is a ground voltage having the same potential as the potential of the main body ground terminal in the case where the drum cartridge is not attached to the main body frame, the main body detection terminal and the main body ground terminal being connected with each other through the main body resistor, wherein, in the case where the drum cartridge is attached to the main body frame, the current flows from the main body voltage terminal toward the main body ground terminal through the cartridge voltage terminal, cartridge resistor, cartridge detection terminal, the main body detection terminal and the main body resistor, so that the voltage at the main body detection terminal, which is positioned between the main body resistor and the cartridge resistor, becomes a second voltage that is lower than the first voltage and higher than the ground voltage, and wherein, when the controller determines whether the main body detection terminal and the cartridge detection terminal are electrically connected with each other, the controller is configured to perform:

determining that main body detection terminal and the cartridge detection terminal are not connected with each other in a case where the voltage of the main body detection terminal is the ground voltage; and determining that main body detection terminal and the cartridge detection terminal are connected with each other in a case where the voltage of the main body detection terminal is the second voltage.

8. The image forming apparatus according to claim 2, wherein the drum cartridge includes a photosensitive drum, and wherein the memory is a drum memory storing information related to the drum cartridge.

9. The image forming apparatus according to claim 8, wherein the drum cartridge comprises a drum frame to which the toner cartridge is attachable, the toner cartridge having a toner memory serving as a storage medium, and wherein the circuit board relays information stored in the toner memory to the controller.

10. The image forming apparatus according to claim 6, wherein the cartridge resistor is a thermistor.

11. The image forming apparatus according to claim 7, wherein the cartridge resistor is a thermistor.

12. The image forming apparatus according to claim 1, wherein the drum cartridge includes a drum frame, to which the toner cartridge is attachable.

13. The image forming apparatus according to claim 1, wherein the one or more cartridge terminals includes a second cartridge detection terminal, the one or more main body terminals includes a second main body detection terminal, and the toner cartridge includes a toner cartridge detection terminal, and wherein determining a connection status of the toner cartridge to the drum cartridge is based on whether the second main body detection terminal and the toner cartridge detection terminal are electrically connected with each other via an electrical connection between the second main body detection terminal and the second cartridge detection terminal.

14. The image forming apparatus according to claim 1, wherein the one or more cartridge terminals includes a cartridge interrupt terminal and the one or more main body terminals includes a main body interrupt terminal, and wherein determining a connection status of the toner cartridge to the drum cartridge is based on an interrupt signal communicated when the cartridge interrupt terminal and the main body interrupt terminal are electrically connected with each other.

* * * * *